US011272820B2

(12) United States Patent
Sato et al.

(10) Patent No.: US 11,272,820 B2
(45) Date of Patent: Mar. 15, 2022

(54) ELECTRIC VACUUM CLEANER DEVICE

(71) Applicant: TOSHIBA LIFESTYLE PRODUCTS & SERVICES CORPORATION, Kawasaki (JP)

(72) Inventors: Tsuyoshi Sato, Owariasahi (JP); Masatoshi Tanaka, Seto (JP); You Torizawa, Seto (JP); Yukio Machida, Owariasahi (JP); Hiromitsu Ichikawa, Owariasahi (JP); Hiromitsu Murata, Kasugai (JP); Takayoshi Shimizu, Kasugai (JP); Yuuji Ohtsuka, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 399 days.

(21) Appl. No.: 16/464,499

(22) PCT Filed: Jun. 2, 2017

(86) PCT No.: PCT/JP2017/020609

§ 371 (c)(1),
(2) Date: May 28, 2019

(87) PCT Pub. No.: WO2018/100773

PCT Pub. Date: Jun. 7, 2018

(65) Prior Publication Data

US 2020/0315419 A1 Oct. 8, 2020

(30) Foreign Application Priority Data

Nov. 30, 2016 (JP) ..... JP2016-232489

(51) Int. Cl.
*A47L 9/28* (2006.01)
*A47L 5/36* (2006.01)
(Continued)

(52) U.S. Cl.
CPC ..... *A47L 9/2873* (2013.01); *A47L 5/225* (2013.01); *A47L 5/36* (2013.01); *A47L 9/20* (2013.01)

(58) Field of Classification Search
CPC . A47L 5/225; A47L 5/36; A47L 9/106; A47L 9/20; A47L 9/242; A47L 9/2873
See application file for complete search history.

(56) References Cited

U.S. PATENT DOCUMENTS 9,907,447 B2 * 3/2018 Tanaka ..... A47L 9/2894
2005/0150519 A1 * 7/2005 Keppler ..... A47L 9/2857 134/19

(Continued)

FOREIGN PATENT DOCUMENTS

CA 2317598 A1 * 7/1999 ..... G05D 1/0225
CN 105708389 A 6/2016

(Continued)

OTHER PUBLICATIONS

International Search Report dated Jul. 11, 2017, in PCT/JP2017/020609 filed on Jun. 2, 2017.

*Primary Examiner* — Marc Carlson
(74) *Attorney, Agent, or Firm* — Oblon, McClelland, Maier & Neustadt, L.L.P.

(57) ABSTRACT

A vacuum cleaner includes a primary dust container that includes a container body, the container body delineating a dust collecting chamber that accumulates dust sucked into the vacuum cleaner and including a waste outlet that discharges the dust accumulated in the dust collecting chamber, the primary dust container also including a waste-outlet lid that opens and closes the waste outlet. A station includes a secondary dust container that accumulates the dust discharged from the primary dust container, and a driving source that generates opening driving force and closing driving force for the waste outlet. The electric vacuum (Continued)

cleaner generates a driving force for opening and closing an air passage connecting a primary dust container and a secondary dust container, without impairing convenience of a vacuum cleaner.

13 Claims, 15 Drawing Sheets

(51) Int. Cl.
*A47L 5/22* (2006.01)
*A47L 9/20* (2006.01)

(56) References Cited

U.S. PATENT DOCUMENTS

2005/0212478 A1* 9/2005 Takenaka ..... A47L 9/2873 320/107
2007/0157416 A1* 7/2007 Lee ..... A47L 9/2894 15/319
2007/0226949 A1* 10/2007 Hahm ..... A47L 9/106 15/340.1
2007/0245511 A1* 10/2007 Hahm ..... A47L 9/1691 15/319
2009/0049640 A1* 2/2009 Lee ..... A47L 9/20 15/319
2012/0291809 A1* 11/2012 Kuhe ..... A47L 11/33 134/18
2017/0196430 A1* 7/2017 Machida ..... A47L 9/106
2018/0029809 A1* 2/2018 Lee ..... A47L 9/009
2020/0315419 A1* 10/2020 Sato ..... A47L 5/36

FOREIGN PATENT DOCUMENTS

DE 102010000607 A1 * 9/2011 ..... A47L 5/362
DE 102010061327 A1 * 6/2012 ..... A47L 9/2884
EP 1961358 A2 * 8/2008 ..... A47L 9/106
EP 3 033 982 A1 6/2016
EP 3033982 A1 * 6/2016 ..... A47L 9/20
JP 2004-283327 A 10/2004
JP 2007-325701 A 12/2007
JP 2015-8755 A 1/2015
JP 2016-116850 A 6/2016
KR 10-2007-0010298 A 1/2007
KR 10-2008-0079075 A 8/2008
WO WO-2007137234 A2 * 11/2007 ..... A47L 11/4025
WO WO-2017047291 A1 * 3/2017 ..... A47L 9/1691

* cited by examiner

ELECTRIC VACUUM CLEANER DEVICE

CROSS-REFERENCE TO RELATED APPLICATION

This application claims the benefit of priority of No. PCT/JP2017/020609, filed on Jun. 2, 2017, and the PCT application is based upon and claims the benefit of priority from Japanese Patent Application No. 2016-232489 filed on Nov. 30, 2016, the entire contents of each of which are incorporated herein by reference.

FIELD

Embodiments according to the present invention relate to an electric vacuum cleaner device.

BACKGROUND

There is known an electric vacuum cleaner device that includes a vacuum cleaner and a charging station. The cleaner body of the vacuum cleaner includes a primary dust container for collecting dust. The charging station includes a secondary dust container for collecting dust. The electric vacuum cleaner device empties the primary dust container by discharging the dust collected in the primary dust container of the vacuum cleaner to the secondary dust container of the charging station.

The vacuum cleaner includes a push button provided on the cleaner body and a switching valve for closing an air passage that connects the primary dust container to an electric blower and opening an air passage that connects the secondary dust container to the electric blower when the push button is pushed down. The vacuum cleaner also includes a first discharging valve provided at the bottom of the primary dust container and a second discharging valve provided at the top of the secondary dust container. The first discharging valve opens when the push button is pushed down. The second discharging valve is opened when being pushed by the first discharging valve that is opened by the push button.

When discharging dust from the cleaner body to the charging station, a user has to place the cleaner body on the charging station and push down the push button of the cleaner body. Then, the air passage connecting the primary dust container and the electric blower is closed, and the air passage connecting the secondary dust container and the electric blower is opened. At the same time, the first discharging valve and the second discharging valve are opened so as to connect the primary dust container and the secondary dust container. Thereafter, when the user operates the cleaner body and thereby the electric blower operates, the flow of air sucked from a suction port of the cleaner body moves the dust collected in the primary dust container to the secondary dust container.

PRIOR ART DOCUMENT

Patent Document

Patent Document 1: JP 2004-283327 A

SUMMARY

Problems to be Solved by Invention

Since the conventional electric vacuum cleaning device requires an operation of the push button for connecting the primary dust container to the secondary dust container so that the dust can be discharged from the primary dust container to the secondary dust container, this is troublesome.

For this reason, it is conceivable to utilize a drive source such as a motor for opening and closing the air passage connecting the two dust containers and for switching the air passages connecting the electric blower and the two dust containers.

However, mounting with the drive source such as the motor on the cleaner body increases the weight of the cleaner body. The increased weight of the cleaner body decreases the convenience of the vacuum cleaner, in particular, decreases the ease of handling. Moreover, the drive source for switching the air passages connecting the electric blower and the two dust containers is not necessary when the vacuum cleaner is used for cleaning, and functions when the vacuum cleaner is attached to the station.

To achieve the above object, an aspect of the present invention provides an electric vacuum cleaner device that generates a driving force for opening and closing an air passage connecting a primary dust container and a secondary dust container, without impairing the convenience of a vacuum cleaner.

Means for Solving Problem

To achieve the above object, an aspect of the present invention provides an electric vacuum cleaner device including a station; and a vacuum cleaner configured to be connectable to and detachable from the station. The vacuum cleaner is equipped with a primary dust container that includes: a container body delineating a dust collecting chamber that accumulates dust sucked into the vacuum cleaner and equipped with a waste outlet that discharges dust accumulated in the dust collecting chamber; and a waste-outlet lid configured to open and close the waste outlet. The station includes: a secondary dust container configured to accumulate dust discharged from the primary dust container; and a drive source configured to generate opening drive force and closing drive force of the waste-outlet lid.

It may be desired that the vacuum cleaner includes: a suction port configured to introduce air directly from outside of an air passage including the primary dust container; and a suction-port lid configured to open and close the suction port; and the drive source is configured to generate opening drive force and closing drive force of the suction-port lid.

It may be further desired that a coupler configured to engage and disengage a power transmission path between the station and the vacuum cleaner, the power transmission path being for transmitting driving force from the drive source to the waste lid.

It may be desired that the coupler includes a coupling.

It may be desired that the coupler is configured to engage a driving part and a driven part of the coupling by driving force of the drive source.

It may be desired that the coupler includes: a spring configured to generate force for disengaging a driving part and a driven part of the coupling; and a cam mechanism configured to convert the driving force generated by the drive source into a force for engaging the driving part and the driven part of the coupling.

It may be further desired that an electric blower configured to apply negative pressure to the secondary dust container after the drive source opens the waste-outlet lid.

It may be further desired that a filter configured to filter and separate dust from air sucked into the primary dust container and a dust-removal mechanism configured to remove dust adhered to the filter. The drive source is configured to generate driving force of the dust-removal mechanism.

DETAILED DESCRIPTION

Hereinbelow, an embodiment of an electric vacuum cleaner device according to the present invention will be described by referring to FIG. 1 to FIG. 15. In each figure, the same reference signs are given for identical or equivalent components.

Figure 1:
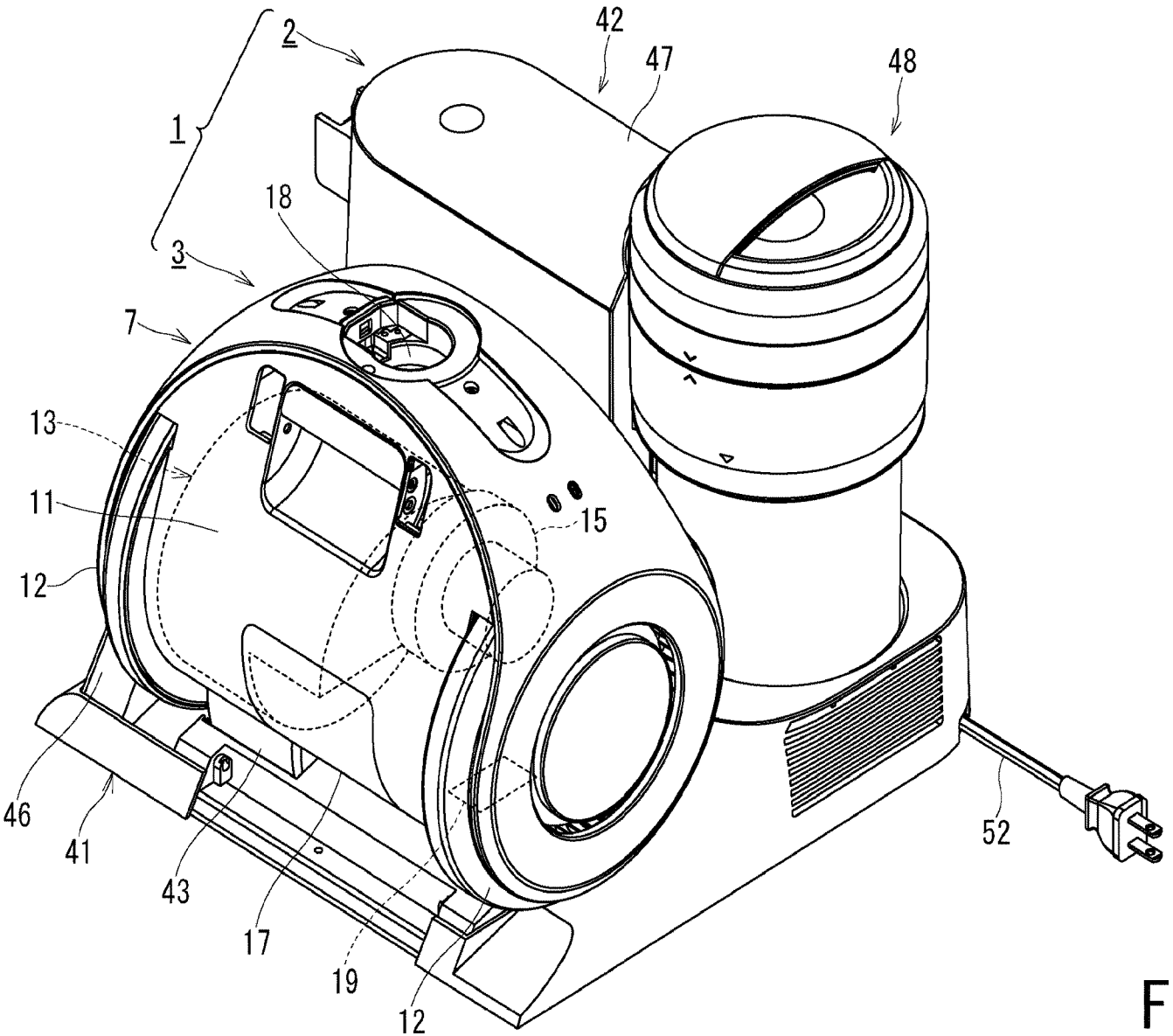
FIG. 1 is a perspective view of an electric vacuum cleaner device according to an embodiment of the present invention.
Figure 2:
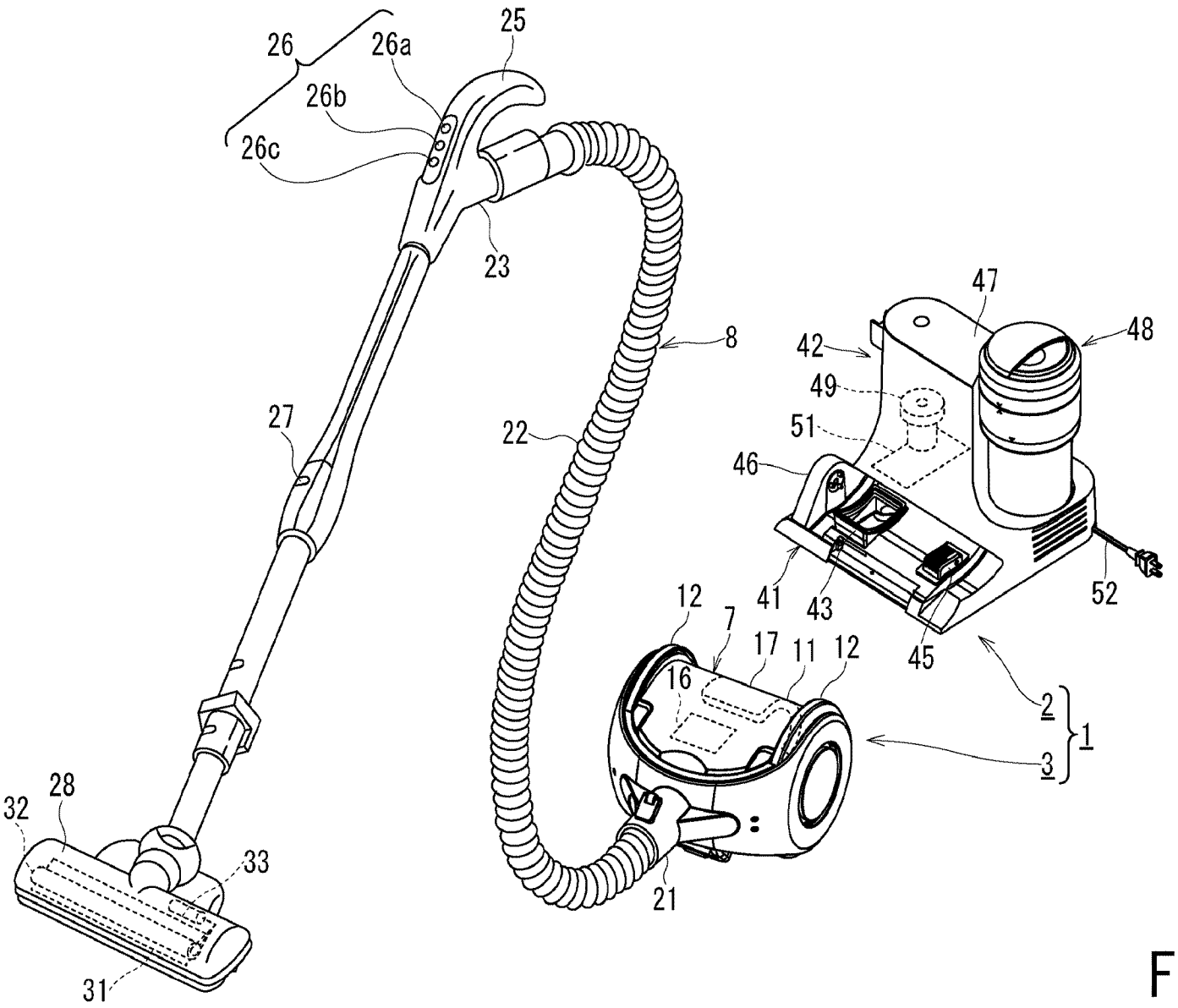
FIG. 2 is another perspective view of the electric vacuum cleaner device according to the embodiment of the present invention.

FIG. 1 and FIG. 2 are perspective views of the electric vacuum cleaner device according to the embodiment of the present invention.

As shown in FIG. 1 and FIG. 2, the electric vacuum cleaner device 1 according to the present embodiment includes a station 2 and a vacuum cleaner 3 that can be connected to and disconnected from the station 2.

FIG. 1 shows a configuration in which the vacuum cleaner 3 is connected to the station 2. This configuration is called the storage configuration of the electric vacuum cleaner device 1. FIG. 2 shows a configuration in which the vacuum cleaner 3 is separated from the station 2. FIG. 2 shows the configuration in which the vacuum cleaner 3 is used for cleaning.

The vacuum cleaner 3 is a so-called cordless type. Although the vacuum cleaner 3 is a so-called canister type, the vacuum cleaner 3 is not limited to this typel; in same embodiments, the vacuum cleaner 3 is an upright type, a stick type, or a handy type.

The station 2 has both functions of charging the vacuum cleaner 3, and the function of collecting the dust collected by the vacuum cleaner 3 and accumulating the collected dust. The station 2 is placed at an arbitrary place in a room.

A user separates the cleaner body 7 of the vacuum cleaner 3 connected to station 2 from the station 2 (FIG. 2) and cleans the surface to be cleaned by running the vacuum cleaner 3 on the surface to be cleaned in the room or by moving with the vacuum cleaner 3 holed in hand. Afterward, the user returns (connects) the cleaner body 7 to the station 2 and stores it (FIG. 1). When the cleaner body 7 is connected to it, the station 2 charges the cleaner body 7 while collecting the dust accumulated by the vacuum cleaner 3 in a timely manner. That is, every time the cleaner body 7 is connected to the station 2 after using the vacuum cleaner 3 for cleaning, the electric vacuum cleaner device 1 collects the dust collected by the vacuum cleaner 3 into the station 2 so as to empty the vacuum cleaner 3.

The frequency of collecting dust from the vacuum cleaner 3 to the station 2 may not be each time of connection of the vacuum cleaner 3 to the station 2. The dust-collection frequency may be each time the number of times of connection of the vacuum cleaner 3 to the station 2 becomes plural. For instance, the dust-collection frequency may be once a week on the premise that vacuum cleaner 3 is used once a day, i.e., the dust collection frequency may be every seven times of the use of the vacuum cleaner 3.

The vacuum cleaner 3 includes a cleaner body 7 capable of traveling on the surface to be cleaned and a hose 8 capable of attached to and detached from the cleaner body 7. The hose 8 is fluidly connected to the cleaner body 7.

The cleaner body 7 includes a body housing 11, a pair of wheels 12 provided on the respective right and left sides of the body housing 11, a primary dust container 13 detachably attached to the body housing 11, a primary electric blower 15 accommodated in the body housing 11, a cleaner controller 16 mainly for controlling the primary electric blower 15, and a rechargeable battery 17 for storing power supplied to the primary electric blower 15.

The cleaner body 7 drives the primary electric blower 15 by using the power stored in the rechargeable battery 17. The cleaner body 7 applies a negative pressure generated by the primary electric blower 15 to the hose 8. The vacuum cleaner 3 sucks dust-containing air from the surface to be cleaned through the hose 8. The vacuum cleaner 3 separates dust from the inhaled dust-containing air. The vacuum cleaner 3 collects and accumulates the dust after separation, and exhausts the clean air from which the dust has been removed.

In the front portion of the body housing 11, there is provided a connection port 18 corresponding to the suction port of the cleaner body 7. The connection port 18 is a coupling joint to/from which the hose 8 can be attached/detached. The connection port 18 fluidly connects the hose 8 and the primary dust container 13.

The cleaner body 7 according to the present embodiment is connected to the station 2 with the connection port 18 directed upward. The cleaner body 7 is connected to the station 2 by being lowered from above and being made to fall down.

The wheels 12 support the cleaner body 7 such that the cleaner body 7 can travel. The cleaner body 7 is supported by non-illustrated casters in addition to the pair of wheels 12.

The primary dust container 13 accumulates the dust sucked into the vacuum cleaner 3. The primary dust container 13 separates, collects, and accumulates the dust from the dust-containing air flowing into the cleaner body 7 while sending the clean air having been subjected to dust-removal to the primary electric blower 15.

The primary electric blower 15 sucks air from the primary dust container 13 so as to generate negative pressure (i.e., suction vacuum pressure).

The cleaner controller 16 includes a non-illustrated microprocessor and a non-illustrated storage device for storing, for example, parameters and various operation programs executed by the microprocessor. The storage device stores various settings (arguments) related to plural preset operation modes. The plural operation modes are related to the output of the primary electric blower 15. Different input values (input values of the primary electric blower 15 and current values flowing to the primary electric blower 15) are set for each operation mode. Each operation mode is associated with a user's operation received with the hose 8. The cleaner controller 16 alternatively selects an arbitrary operation mode corresponding to the user's operation received with the hose 8 from the plural preset operation modes, and reads out the selected operation mode from the storage device so as to drive the primary electric blower 15 on the basis of the settings of the operation mode having been read out.

The rechargeable battery 17 supplies power to the primary electric blower 15 and the cleaner controller 16. The rechargeable battery 17 is electrically connected to a pair of charging electrodes 19 provided on the cleaner body 17.

The hose 8 sucks dust-containing air from the surface to be cleaned by the negative pressure that acts from the cleaner body 7, and leads the dust-containing air to the cleaner body 7. The hose 8 includes a connecting tube 21 as a joint detachably connected to the cleaner body 7, a dust collecting hose 22 fluidly connected to the connecting tube 21, a hand operation tube 23 fluidly connected to the dust collecting hose 22, a grip 25 protruding from the hand operation tube 23, an input unit 26 provided on the grip 25, an extension tube 27 detachably connected to the hand operation tube 23, and a cleaning head 28 detachably connected to the extension tube 27.

The connecting tube 21 is the joint that is detachable with respect to the connection port 18, and is fluidly connected to the primary dust container 13 through the connection port 18.

The dust collecting hose 22 is a long, flexible, and substantially cylindrical hose. One end portion (i.e., the rear end portion in this case) of the dust collecting hose 22 is fluidly connected to the connecting tube 21. The dust collecting hose 22 is fluidly connected to the primary dust container 13 through the connecting tube 21.

The hand operation tube 23 relays the dust collecting hose 22 and the extension tube 27. One end portion (i.e., the rear end portion in this case) of the hand operation tube 23 is fluidly connected to the other end portion (i.e., the front end portion in this case) of the dust collecting hose 22. The hand operation tube 23 is fluidly connected to the primary dust container 13 through the dust collecting hose 22 and the connecting tube 21.

The grip 25 is a portion that is gripped by a user's hand operating the vacuum cleaner 3. The grip 25 protrudes from the hand operation tube 23 in an appropriate shape that can be easily grasped by the user's hand.

The input unit 26 includes switches corresponding to the respective operation modes. For instance, the input unit 26 includes a stop switch **26*a* corresponding to the operation of stopping the primary electric blower 15, a start switch 26*b* corresponding to the operation of starting the primary electric blower 15, and a brush switch 26*c* corresponding to power supply to the cleaning head 28. The stop switch 26*a* and the start switch 26*b* are electrically connected to the cleaner controller 16. A user of the vacuum cleaner 3 can operate the input unit 26 to alternatively select one of the operation modes of the primary electric blower 15. The start switch 26*b* also functions as a selecting switch of the operation modes during operation of the primary electric blower 15. Each time the cleaner controller 16 receives an operation signal from the start switch 26*b*, the cleaner controller 16 switches the operation mode in order of strong→medium→weak→strong→medium→weak→ . . . . Instead of the start switch 26*b*, the input unit 26** may be individually equipped with a strong-mode operation switch, a medium-mode operation switch, and a weak-mode operation switch (not shown).

The extension tube 27 has a telescopic structure in which plural tubular bodies are superimposed, and can be expanded and contracted. A joint structure is provided at one end portion (i.e., the rear end portion in this case) of the extension tube 27, and this joint structure is detachable with respect to the other end portion (i.e., the front end portion in this case) of the hand operation tube 23. The extension tube 27 is fluidly connected to the primary dust container 13 through the hand operation tube 23, the dust collecting hose 22, and the connecting tube 21.

The cleaning head 28 can run or slide on the surface to be cleaned such as a wooden floor and a carpet, and includes a suction port 31 on its bottom surface opposed to the surface to be cleaned in a running state or a sliding state. In addition, the cleaning head 28 includes a rotatable brush 32 arranged at the suction port 31 and an electric motor 33 for driving the rotatable brush 32. A joint structure is provided on one end portion (i.e., the rear end portion in this case) of the cleaning head 28, and this joint structure is detachable with respect to the other end portion (i.e., the front end portion in this case) of the extension tube 27. The cleaning head 28 is fluidly connected to the primary dust container 13 through the extension tube 27, the hand operation tube 23, the dust collecting hose 22, and the connecting tube 21. That is, the cleaning head 28, the extension tube 27, the hand operation tube 23, the dust collecting hose 22, the connecting tube 21, and the primary dust container 13 constitute a suction-air passage from the suction port 31 to the primary electric blower 15. Each time the electric motor 33 receives the operation signal from the brush switch **26*c*, the electric motor 33** alternately repeats the operation start and the operation stop.

When the start switch **26*b* is operated, the vacuum cleaner 3 starts up the primary electric blower 15. For instance, when the start switch 26*b* is operated under the state where the primary electric blower 15 is stopped, first, the vacuum cleaner 3 starts the primary electric blower 15 in the strong operation mode. When the start switch 26*b* is operated again in the strong operation mode, the vacuum cleaner 3 switches the operation mode of the primary electric blower 15 to the medium operation mode. When the start switch 26***b* is operated three times, the vacuum cleaner 3 switches the operation mode of the primary electric blower 15 to the weak operation mode. In this manner, every time the start switch 26*b* is operated, the above-described mode switching is repeated. The strong operation mode, the medium operation mode, and the weak operation mode are plural predetermined operation modes, and the input value to the primary electric blower 15 is smaller in order of the strong operation mode, the medium operation mode, and the weak operation mode. The primary electric blower 15 having started up sucks air from the primary dust container 13 so as to bring the inside of the primary dust container 13 into a negative pressure state.

The negative pressure inside the primary dust container 13 sequentially passes through the connection port 18, the connecting tube 21, the dust collecting hose 22, the hand operation tube 23, the extension tube 27, and the cleaning head 28 so as to act on the suction port 31. The vacuum cleaner 3 sucks the dust on the surface to be cleaned together with the air by the negative pressure acting on the suction port 31. The primary dust container 13 separates, collects, and accumulates dust from the dust-containing air having been sucked, and sends the air having been separated from the dust-containing air to the primary electric blower 15. The primary electric blower 15 discharges the air sucked from the primary dust container 13 to the outside of the cleaner body 7.

The station 2 is installed at an arbitrary place on the surface to be cleaned. The station 2 includes a platform 41 connectable to the cleaner body 7 and a dust collection unit 42 integrally provided on the platform 41. Further, the station 2 includes a dust transfer tube 43 connectable to the primary dust container 13 of the vacuum cleaner 3 in the storage configuration of the electric vacuum cleaner device 1.

The platform 41 has substantially the same width dimension as that of the dust collection unit 42, and protrudes to the front side of the dust collection unit 42 so as to spread in a rectangular shape. The platform 41 has a shape and size by which the platform 41 can accommodate the cleaner body 7 of the vacuum cleaner 3 in a plan view.

The platform 41 has a charging terminal 45 connectable to the cleaner body 7. When the vacuum cleaner 3 is connected to the station 2, the charging terminal 45 contacts the charging electrodes 19 of the cleaner body 17 and is electrically connected to the charging electrodes 19.

The platform 41 has a bulge 46 that is disposed to be close to and along the side surface of the cleaner body 7 in the storage configuration of the electric vacuum cleaner device 1.

The dust collection unit 42 is disposed behind the platform 41. The dust collection unit 42 is a box formed in an appropriate shape such that the dust collection unit 42 can be placed on the surface to be cleaned integrally with the platform 41. The dust collection unit 42 is taller than the platform 41. The dust collection unit 42 has an appropriate shape that does not interfere with the cleaner body 7 connected to the platform 41.

The dust collection unit 42 includes a housing 47, a secondary dust container 48 for collecting the dust discharged from the primary dust container 13 through the dust transfer tube 43 and accumulates the collected dust, a secondary electric blower 49 accommodated in the dust collection unit 42 and fluidly connected to the secondary dust container 48, a station controller 51 for mainly controlling the secondary electric blower 49, and a power cord 52 for leading power from a commercial AC power supply to the dust collection unit 42.

The top plate of the housing 47 and the platform 41 is an integral molding of resin.

The secondary dust container 48 is fluidly connected to the dust transfer tube 43. The secondary dust container 48 separates, collects, and accumulates dust from the dust-containing air flowing from dust transfer tube 43, and sends the clean air having been subjected to the dust-removal to the secondary electric blower 49. The secondary dust container 48 is detachably mounted on the left side (i.e., right side as viewed from the front) of the dust collection unit 42 and exposed to the appearance of the station 2.

The secondary electric blower 49 sucks in air from the secondary dust container 48 so as to generate negative pressure (i.e., suction vacuum pressure), and moves the dust from the primary dust container 13 to the secondary dust container 48. The secondary electric blower 49 is accommodated in the right part (i.e., left part as viewed from the front) of the dust collection unit 42.

The station controller 51 includes a non-illustrated microprocessor and a non-illustrated storage device for storing, for example, parameters and various operation programs executed by the microprocessor. The station controller 51 performs drivability control of the secondary electric blower 49 and charge control of the rechargeable battery 17 of the vacuum cleaner 3.

The dust transfer tube 43 is connected to the primary dust container 13 in the storage configuration of the electric vacuum cleaner device 1. The dust transfer tube 43 is an air passage for moving the dust collected by the vacuum cleaner 3 to the secondary dust container 48. When the vacuum cleaner 3 is connected to the station 2, the dust transfer tube 43 is connected to the primary dust container 13 and fluidly connects the primary dust container 13 and the secondary dust container 48.

The dust transfer tube 43 is connected to the suction side of the secondary dust container 48. The negative pressure generated by the secondary electric blower 49 acts on the dust transfer tube 43 via the secondary dust container 48.

The dust transfer tube 43 includes an inlet connected to the primary dust container 13 of the vacuum cleaner 3 and an outlet connected to the secondary dust container 48. The dust transfer tube 43 extends rearward from the inlet located at the platform 41 so as to reach the inside of the dust collection unit 42, and bends and extends upward inside the dust collection unit 42 so as to reach the outlet located at the side of the secondary dust container 48.

The charging terminal 45 and the inlet of the dust transfer tube 43 are provided on the platform 41 side by side.

When the vacuum cleaner 3 is connected (i.e., returned) to the station 2, the charging electrodes 19 of the vacuum cleaner 3 are electrically connected to the charging terminal 45 of the station 2 and the dust transfer tube 43 of the station 2 is connected to the primary dust container 13. After this, the station 2 starts charging the rechargeable battery 17 of the vacuum cleaner 3. Additionally, the station 2 starts the secondary electric blower 49 in a timely manner. The secondary electric blower 49 having started up sucks air from the secondary dust container 48 and brings the inside of the secondary dust container 48 into a negative pressure state.

The negative pressure in the secondary dust container 48 acts on the primary dust container 13 through the dust transfer tube 43. The station 2 sucks the dust accumulated in the primary dust container 13 together with air by using the negative pressure acting on the primary dust container 13. The secondary dust container 48 separates, collects, and accumulates dust from the sucked air, and sends the dust-separated air to the secondary electric blower 49. The secondary electric blower 49 discharges the clean air sucked from the secondary dust container 48 to the outside of the station 2.

Next, the cleaner body 7 of the vacuum cleaner 3 according to the embodiment of the present invention will be described in detail.

Figure 3:
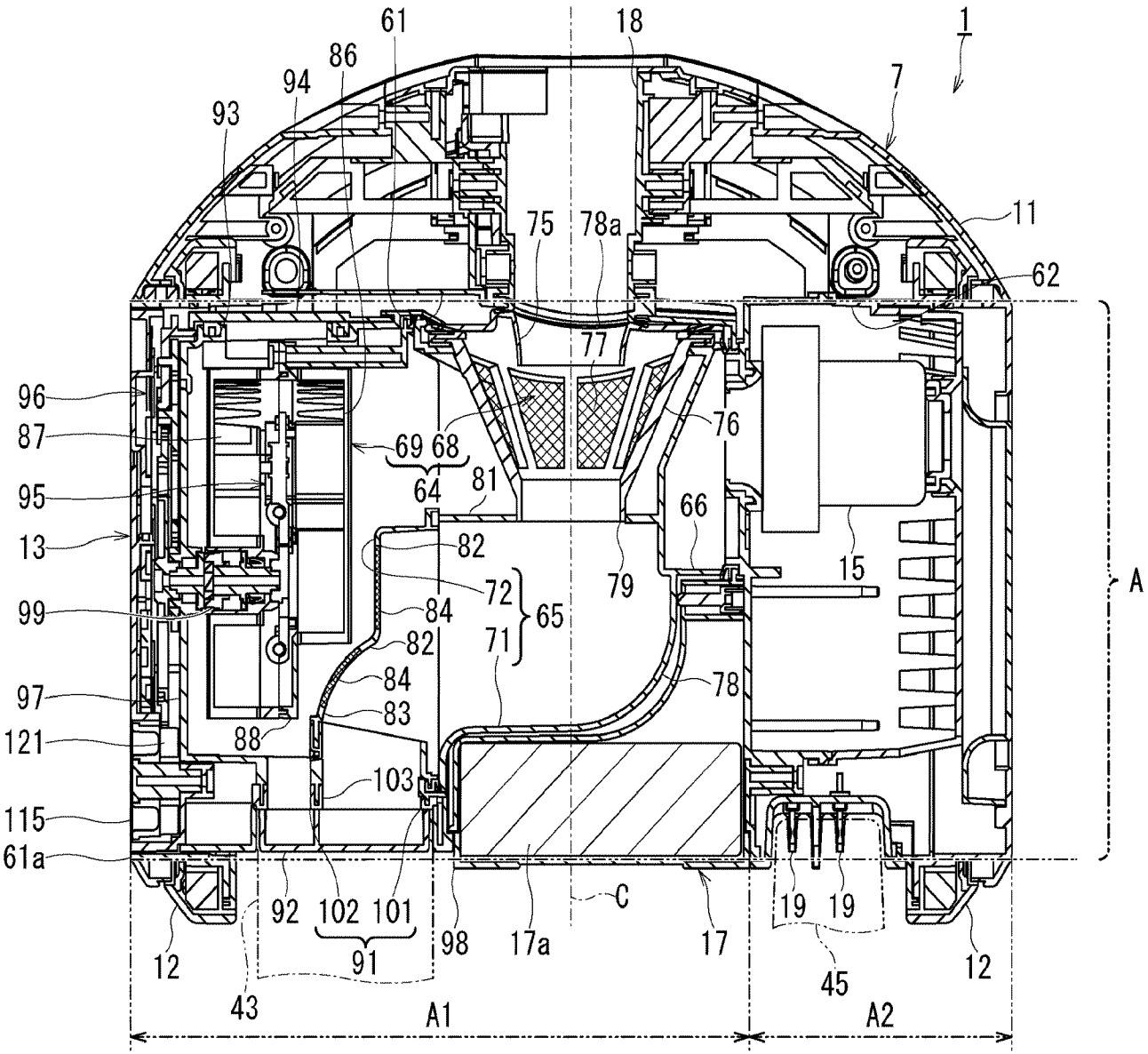
FIG. 3 is a cross-sectional plan view of a cleaner body of the electric vacuum cleaner device according to the embodiment of the present invention.

FIG. 3 is a cross-sectional plan view of the cleaner body of the electric vacuum cleaner device according to the embodiment of the present invention.

Figure 4:
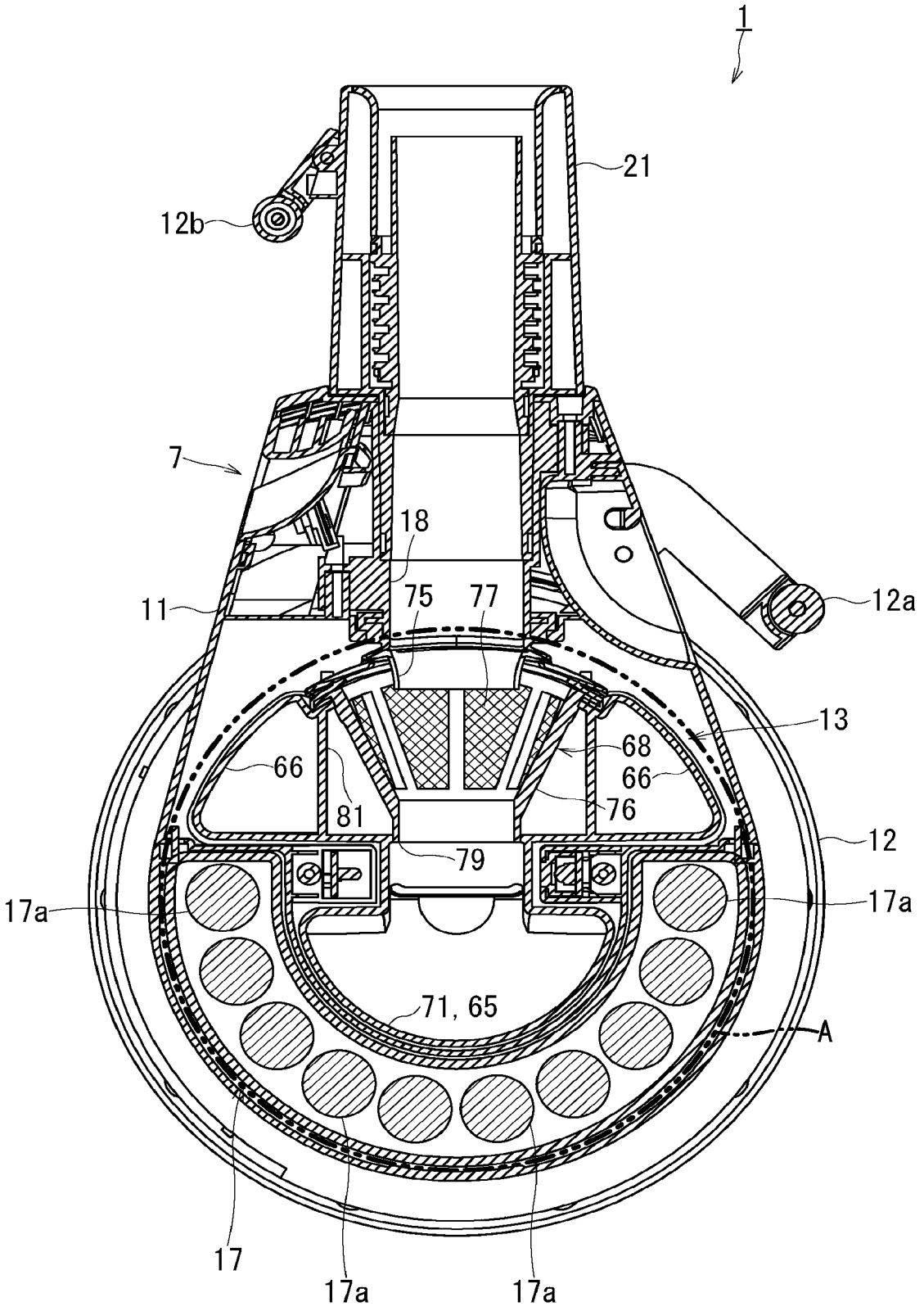
FIG. 4 is a longitudinal cross-sectional view of the cleaner body of the electric vacuum cleaner device according to the embodiment of the present invention.

FIG. 4 is a longitudinal cross-sectional view of the cleaner body of the electric vacuum cleaner device according to the embodiment of the present invention.

The cross-sectional plane of the cleaner body 7 shown in FIG. 3 corresponds to the cross-section in a plane that is substantially parallel to the front in the storage configuration of the electric vacuum cleaner device 1. FIG. 3 shows the state where the connecting tube 21 of the hose 8 is detached from the cleaner body 7. FIG. 4 shows the state where the connecting tube 21 is attached to the cleaner body 7.

As shown in FIG. 3 and FIG. 4, the cleaner body 7 of the electric vacuum cleaner device 1 according to the embodiment of the present invention includes the body housing 11 that includes a cylindrical rear half extending in the width direction of the body housing 11 and a front half bulging forward in an arc from the cylindrical rear half in a plan view.

The connection port 18 extends along a line passing through the substantial center in the width direction of the body housing 11 and the substantial center in the height direction (hereinafter, referred to as the centerline C) so as to reach the primary dust container 13. FIG. 3 and FIG. 4 are cross-sectional views passing through the centerline C.

The respective wheels 12 are disposed at the right and left end portions of the cylindrical rear half of the body housing 11. In addition, each wheel 12 is concentrically arranged in the cylindrical rear half of the body housing 11. The diameter of each wheel 12 is larger than the vertical dimension of the body housing 11, i.e., larger than the height (corresponding to the diameter of the cylindrical rear half) of the body housing 11. In a side view of the cleaner body 7, i.e., when viewed in the rotational centerline direction of the wheels 12, the wheels 12 obscure the back of the body housing 11. Thus, even when the upper and lower sides (obverse and reverse) of the body housing 11 are inverted, the cleaner body 7 can cause the wheels 12 to be grounded to the surface to be cleaned. Similarly, even in the process of inverting the upper and lower sides of the body housing 11, the cleaner body 7 can cause the wheels 12 to be grounded to the surface to be cleaned. The body housing 11 can invert the upper and lower sides (i.e., obverse and reverse) of the body housing 11 around the rotational centerline of the wheels 12 without causing the back surface to interfere with the surface to be cleaned. The cleaner body 7 is provided with an auxiliary wheel 12*a* for supporting the cleaner body 7, the reverse of which faces upward, together with the wheels 12. The connecting tube 21 is provided with an auxiliary wheel 12*b* for supporting the cleaner body 7, the reverse of which faces upward, together with the wheels 12. The distinction between the upper and lower sides (i.e., obverse and reverse) of the cleaner body 7 is for the convenience of description. The vacuum cleaner 3 can be used for cleaning in the same manner regardless of whether the obverse is directed upward or the reverse is directed upward.

The rechargeable battery 17 is disposed on the opposite of the connection port 18 with the rotational centerline of the wheels 12 interposed between the rechargeable battery 17 and the connection port 18, i.e., is disposed at the central portion of the rear end of the body housing 11. That is, the rechargeable battery 17 is accommodated in the cylindrical rear half of the body housing 11. The rechargeable battery 17 includes plural cylindrical unit cells 17*a* that are arranged along the inner surface of the cylindrical rear half.

The centerline of the cylindrical rear half of the body housing 11 and the rotational centerline of the wheels 12 are substantially on the same line. The inside of the cylindrical rear half of the body housing 11 centered on this line is defined as a region A. The wheels 12 are disposed so as to avoid the region A. That is, each wheel 12 has an annular shape which has an inner diameter larger than that of the region A.

The primary dust container 13 and the primary electric blower 15 are disposed in the region A and arranged in the width direction of the body housing 11. The primary dust container 13 is disposed in a region A1 that reaches one of the wheels 12 (e.g., the right wheel 12 when the cleaner body 7 is connected to the station 2) from the central portion of the region A. The primary electric blower 15 is disposed in a region A2 that is biased to the other wheel 12 (e.g., the left wheel 12 when the cleaner body 7 is connected to the station 2) in the region A.

The body housing 11 includes a dust container chamber 61 for removably accommodating the primary dust container 13, and an electric blower chamber 62 for accommodating the primary electric blower 15. The dust container chamber 61 occupies the region A1. The electric blower chamber 62 occupies the region A2.

The primary electric blower 15 is accommodated in the electric blower chamber 62. The suction port of the primary electric blower 15 is directed to the dust container chamber 61.

The dust container chamber 61 partitions a cylindrical space conforming to the shape of the primary dust container 13. The dust container chamber 61 is equipped with a dust-container insertion and extraction port 61*a* disposed on the side surface of the body housing 11. The opening diameter of the dust-container insertion and extraction port 61*a* is smaller than the inner diameter of each annular wheel 12. The dust-container insertion and extraction port 61*a* is disposed inside the annular wheels 12 in a side view of the cleaner body 7.

The primary dust container 13 has a cylindrical appearance with an outer diameter smaller than the inner diameter of each wheel 12. The primary dust container 13 is inserted into and extracted from the dust container chamber 61 through the dust-container insertion and extraction port 61*a*. That is, the primary dust container 13 is inserted and extracted in the width direction of the cleaner body 7. As a result, the primary dust container 13 is attached to and detached from the cleaner body 7.

Next, the primary dust container 13 of the vacuum cleaner 3 according to the present embodiment will be described.

Figure 5:
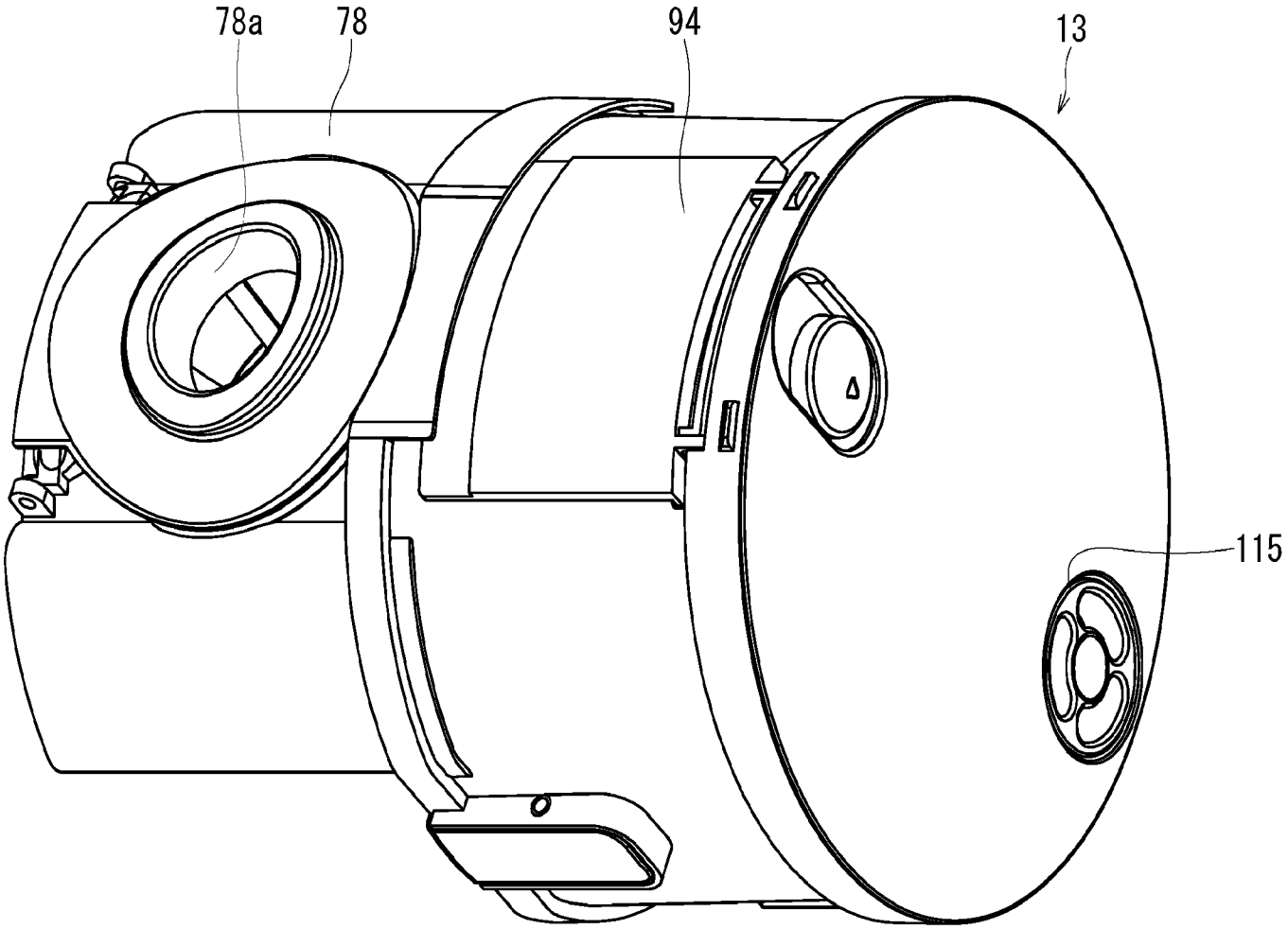
FIG. 5 is a perspective view of a primary dust container of the vacuum cleaner according to the embodiment of the present invention.

FIG. 5 is a perspective view of the primary dust container of the vacuum cleaner according to the embodiment of the present invention.

Figure 6:
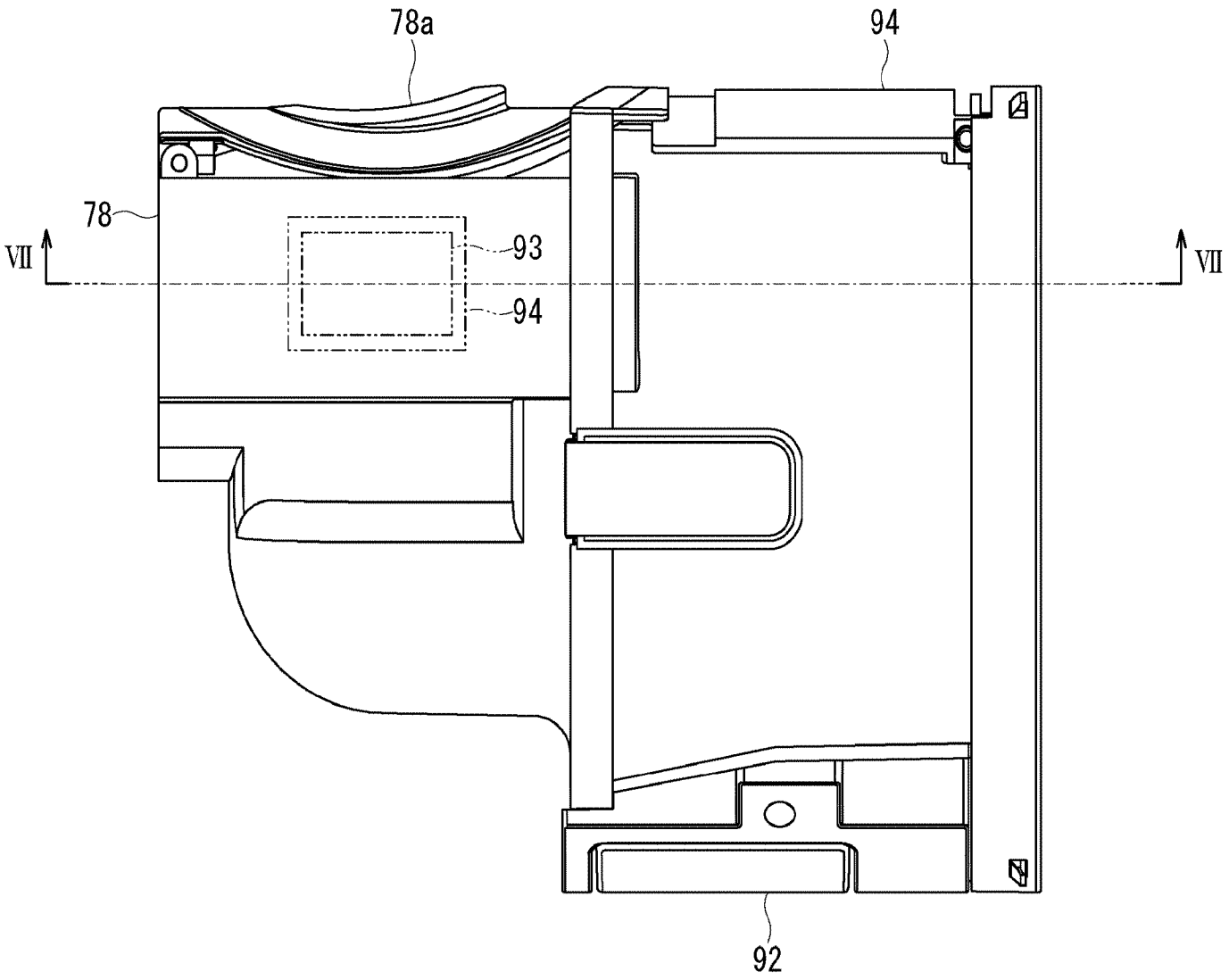
FIG. 6 is a side view of the primary dust container of the vacuum cleaner according to the embodiment of the present invention.

FIG. 6 is a side view of the primary dust container of the vacuum cleaner according to the embodiment of the present invention.

Figure 7:
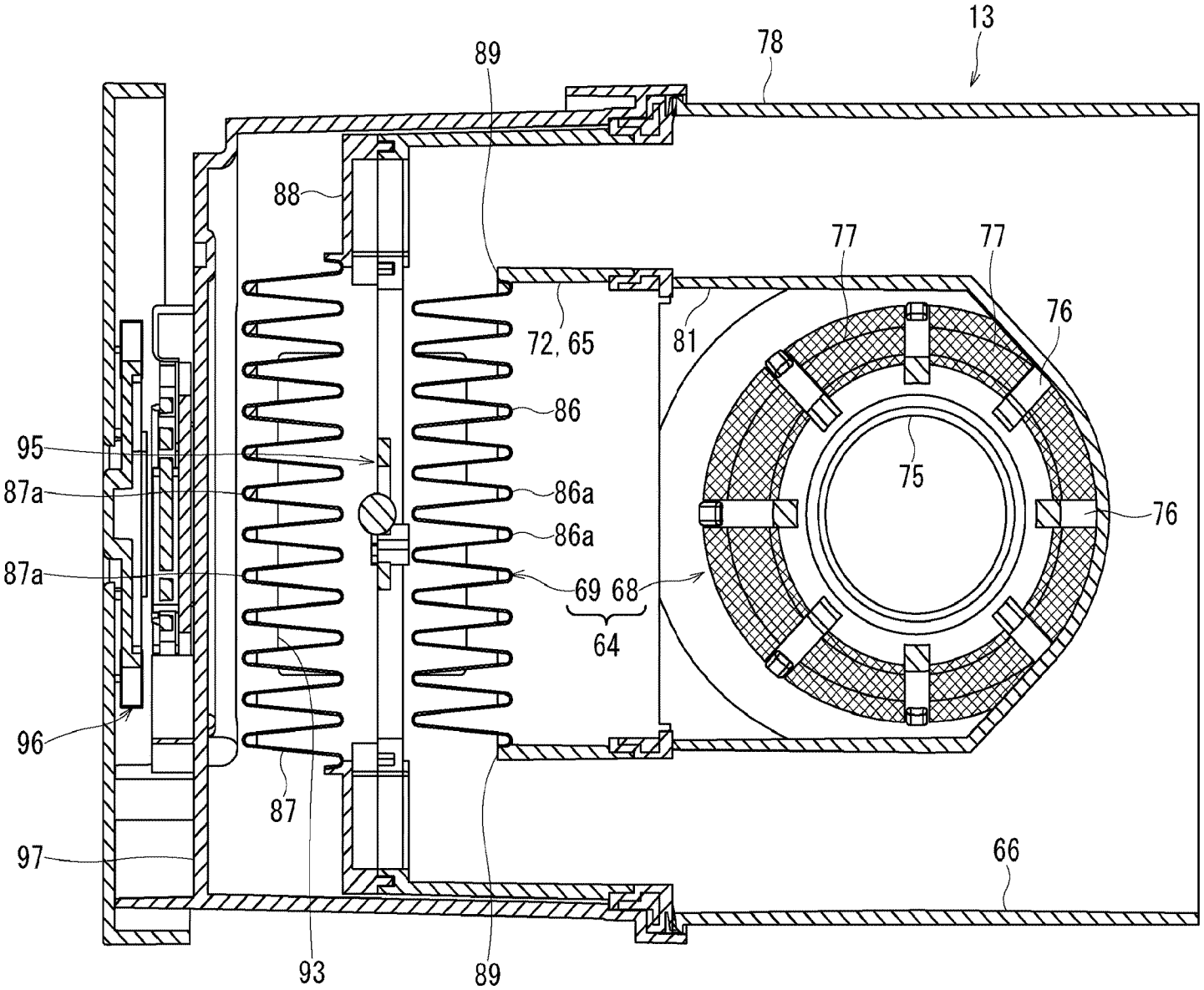
FIG. 7 is a cross-sectional view of the primary dust container of the vacuum cleaner according to the embodiment of the present invention.

FIG. 7 is a cross-sectional view of the primary dust container of the vacuum cleaner according to the embodiment of the present invention, taken along line VII-VII in FIG. 6.

As shown in FIG. 5 to FIG. 7 in addition to FIG. 3 and FIG. 4, the primary dust container 13 of the vacuum cleaner 3 according to the present embodiment accumulates the dust sucked into the vacuum cleaner 3. The primary dust container 13 includes a separation unit 64 that separates the dust from dust-containing air sucked by the negative pressure generated by the primary electric blower 15, a dust collection unit 65 that accumulates the dust separated by the separation unit 64, and a communication passage 66 that leads the air flowing out of the dust collection unit 65 to the primary electric blower 15.

The separation unit 64 is connected to the connection port 18. The separation unit 64 includes a first separator 68 that separates relatively heavy dust from the dust-containing air due to the difference between an inertial force acting on dust contained in the dust-containing air going straight and an inertial force acting on the air in it, and a filter 69 as a second separator that separates dust from the air, which contains relatively light dust after passing through the first separator 68.

The dust collection unit 65 is provided side by side with the separation unit 64 and the communication passage 66. The dust collection unit 65 includes a filter chamber 72 for accommodating the filter 69 and a coarse-dust collecting chamber 71 for accumulating relatively heavy dust among the dust separated by the separation unit 64.

The relatively heavy dust separated by the first separator 68 is called coarse dust. The relatively light dust separated by the filter 69 is called fine dust. The coarse-dust collecting chamber 71 and the filter chamber 72 are collectively referred to as a dust collecting chamber 73.

The dust-containing air flowing from the connection port 18 to the primary dust container 13 is separated with the first separator 68 into coarse dust and the rest (i.e., air containing fine dust). The separated coarse dust is accumulated in the coarse-dust collecting chamber 71. The air containing fine dust separated with the first separator 68 flows into the filter chamber 72. The air flowing into the coarse-dust collecting chamber 71 also flows into the filter chamber 72. The air containing fine dust having flowed into the filter chamber 72 is separated into fine dust and air with the filter 69. The separated fine dust is captured with the filter 69 and accumulated in the filter chamber 72. The clean air having passed through the filter 69 is sucked into the primary electric blower 15 through the communication passage 66.

The first separator 68 includes a nozzle 75 connected to the connection port 18, a first mesh filter 77, and a primary filter frame 76 that includes the nozzle 75 inside and is in the shape of a truncated cone.

The nozzle 75 extends into a container body 78 from the suction port 78*a* of the container body 78 corresponding to the outer shell of the primary dust container 13.

The primary filter frame 76 is provided on the inner surface of the container body 78. The primary filter frame 76 tapers and extends along the centerline of the connection port 18, i.e., substantially along the centerline C of the cleaner body 7 when the primary dust container 13 is attached to the body housing 11. The large-diameter bottom portion is in contact with the inner surface of the container body 78, and the small-diameter bottom portion has a coarse-dust discharge port 79 connected to the coarse-dust collecting chamber 71 of the dust collection unit 65. The diameter of the large-diameter bottom portion is larger than the opening diameter of the suction port 78*a*. The centerline of the coarse-dust discharge port 79 is substantially along the centerline of the suction port 78*a* and substantially along the centerline of the connection port 18.

The first mesh filter 77 is provided on the side surface of the primary filter frame 76. Outside the first mesh filter 77, a relay passage 81 connected to the filter chamber 72 is partitioned.

The pressure in the first separator 68 is decreased to a negative pressure due to the flow of air sucked into the primary electric blower 15 through the first mesh filter 77 and the flow of air sucked into the primary electric blower 15 through the coarse-dust discharge port 79.

The coarse-dust collecting chamber 71 accumulates relatively heavy dust separated by the first separator 68. The coarse-dust collecting chamber 71 is a part of the passage of the air sucked into the primary electric blower 15. The coarse-dust collecting chamber 71 is connected to the coarse-dust discharge port 79 of the first separator 68. The coarse-dust collecting chamber 71 is also connected to the filter chamber 72. The coarse-dust collecting chamber 71 is disposed on the centerline of the connection port 18, i.e., substantially on the centerline C of the cleaner body 7. The coarse-dust collecting chamber 71 is expanded in the direction away from the primary electric blower 15, i.e., in the direction approaching the filter 69. Between this expanded portion and the filter chamber 72 in which the filter 69 is accommodated, a partition wall 83 having plural coarse-dust collecting chamber outlets 82 is provided. A second mesh filter 84 is provided on the coarse-dust collecting chamber outlets 82 of the partition wall 83. The second mesh filter 84 prevents coarse dust from flowing out of the coarse-dust collecting chamber 71 into the filter chamber 72. Additionally, the second mesh filter 84 compresses the dust accumulated in the coarse-dust collecting chamber 71 by the flow of air passing through it. The second mesh filter 84 has substantially the same mesh as the first mesh filter 77. The fine dust flowing into the coarse-dust collecting chamber 71 without being separated by the first separator 68 passes through the second mesh filter 84 so as to flow into the filter chamber 72 or is captured by coarse dust compressed like a filter inside the coarse-dust collecting chamber 71.

The filter 69 filters and separates dust, particularly the fine dust having passed through the first separator 68, from the dust-containing air sucked by the negative pressure generated by the primary electric blower 15. The filter 69 includes a pair of filters 86 and 87 facing each other and a secondary filter frame 88 that maintains the shape of the pair of filters 86 and 87 so as to support the filters 86 and 87.

Downstream faces of the respective filters 86 and 87 face each other. Each filter 86, 87 filters and separates dust from the dust-containing air drawn into the primary dust container 13. The mesh of each of the filters 86 and 87 is finer than the first mesh filter 77 of the first separator 68 and the second mesh filter 84 of the coarse-dust collecting chamber 71. The filters 86 and 87 are, e.g., non-woven fabrics. The dust captured by the filters 86 and 87 contains the dust that can pass through the first mesh filter 77 and the second mesh filter 84.

One of the filters 86 and 87 (filter 86) is directly exposed to the air flowing into the filter chamber 72, and the other of the filters 86 and 87 (filter 87) is exposed to the air that has run around one of the filters 86 and 87 (filter 86). That is, the filter 86 faces the relay passage 81 connecting the first separator 68 and the filter 69, and faces the coarse-dust collecting chamber outlets 82 connecting the coarse-dust collecting chamber 71 and the filter chamber 72. The filter 87 is hidden by the filter 86 and disposed at the position where the filter 87 cannot be seen from the relay passage 81 and the coarse-dust collecting chamber outlets 82.

The pair of filters 86 and 87 are pleated filters having folds (ridge lines 86*a* and 87*a*) which are substantially the same as each other in size (spacing) and in depth.

The filter 86 facing the relay passage 81 and the coarse-dust collecting chamber outlets 82 may have a wider and shallower fold as compared with the filter 87. Since the filter 86 faces the relay passage 81 and the coarse-dust collecting chamber outlets 82, the dust passing through the first separator 68 and the dust flowing out of the coarse-dust collecting chamber 71, i.e., fine dust first blow on the filter 86. Then, the filter 86 captures fine dust and causes clogging gradually. As the filter 86 is clogged, fine dust blowing from the relay passage 81 and the coarse-dust collecting chamber outlets 82 to the filter 86 is circulated to the filter 87. Consequently, clogging of the filter 87 also starts. That is, the filter 86 is more likely to be clogged than the filter 87. In other words, dust is more easily adhered to the filter 86 as compared with the filter 87. Thus, the dust can be easily removed from the filter 86, to which dust is more likely to be attached, by making the fold of the filter 86 wider and shallower than the filter 87.

The filters 86 and 87 may have a film of polytetrafluoroethylene (PTFE, so-called Teflon (registered trademark)) on the upstream surface so as to easily remove the attached dust. Additionally, only the filter 86, which is more easily clogged than the filter 87, may have a polytetrafluoroethylene film on the upstream surface.

The filters 86 and 87 have ridge lines (folds) 86*a* and 87*a* extending in the up-and-down direction (i.e., vertical direction) in the storage configuration of the electric vacuum cleaner device 1. In other words, the ridge lines 86*a* and 87*a* of the filters 86 and 87 extend in the front-and-rear direction of the cleaner body 7. Each of the filters 86 and 87 is open at the end face intersecting the fold.

The open end face of each filter 86 (87) may be a zigzag shape having mountains and valleys along the end face shape of each filter 86 (87) or may be a surface in which a plate-shaped frame having non-illustrated ventilating holes are interposed between adjacent mountain folds.

The secondary filter frame 88 supports the pair of filters 86 and 87 such that the pair of filters 86 and 87 face each other and are spaced apart. The space partitioned by the secondary filter frame 88 and the pair of filters 86 and 87 corresponds to the air passage on the downstream of the filter 69. The internal space of this filter 69 communicates with the communication passage 66. The secondary filter frame 88 has secondary filter outlets 89 that are located on both sides of the filter 86 and connected to the communication passage 66. The secondary filter outlets 89 cause the air having passed through the filters 86 and 87 to flow out to the communication passage 66.

The filter chamber 72 functions as a fine-dust collecting chamber that accumulates fine dust captured by the filter 69 by filtration separation. Fine dust passing through the first mesh filter 77 and the second mesh filter 84 is captured by the pair of finer mesh filters 86 and 87, and then is accumulated in the filter chamber 72. That is, the dust collecting chamber 73 (i.e., the coarse-dust collecting chamber 71 and the filter chamber 72) is disposed on the upstream of the filters 86 and 87.

The filter chamber 72 is a part of the passage of the air sucked into the primary electric blower 15. The filter chamber 72 communicates with the relay passage 81. The filter chamber 72 also communicates with the coarse-dust collecting chamber 71.

Among the dust-containing air flowing from the nozzle 75 to the first separator 68, coarse dust of relatively large mass goes straight from the nozzle 75 to the coarse-dust discharge port 79 by inertia force and then is sent to the coarse-dust collecting chamber 71. The dust (coarse dust) flowing from the coarse-dust discharge port 79 into coarse-dust collecting chamber 71 is accumulated in the coarse-dust collecting chamber 71. The air and dust of relatively small mass included in the dust-containing air flowing from the nozzle 75 to the first separator 68 expand radially from the nozzle 75, pass through the first mesh filter 77 provided on the side surface of the primary filter frame 76, and flow into the filter chamber 72 via the relay passage 81. Along with the dust (coarse dust) flowing from the coarse-dust discharge port 79 into the coarse-dust collecting chamber 71, a part of the air also flows into the coarse-dust collecting chamber 71. The air having flowed into the coarse-dust collecting chamber 71 passes through the second mesh filter 84 and flows into the filter chamber 72. The fine dust contained in the air flowing into the filter chamber 72 after passing through the first mesh filter 77 or the second mesh filter 84 is filtered and separated by the filter 69 so as to be captured on the surfaces of the pair of filters 86 and 87. The clean air passing through the filters 86 and 87 is drawn into the primary electric blower 15 via the communication passage 66.

The container body 78 delineates the dust collecting chamber 73, i.e., the coarse-dust collecting chamber 71 and the filter chamber 72. The communication passage 66 and the first separator 68 of the separation unit 64 are disposed between the filter 69 and the primary electric blower 15 to be side by side with each other.

The pair of wheels 12 sandwich the primary electric blower 15, the separation unit 64 (i.e., the first separator 68 and the filter 69), the dust collection unit 65 (i.e., the coarse-dust collecting chamber 71 and the filter chamber 72), and the communication passage 66.

The first separator 68 is disposed at the central portion of the body housing 11 in the width direction, the filter 69 is offset to one side of the body housing 11 (e.g., biased to the right side), and the primary electric blower 15 is offset to the other side of the body housing 11 (e.g., biased to the left side).

The primary dust container 13 includes the container body 78 that partitions the dust collecting chamber 73 for accumulating the dust sucked into the vacuum cleaner 3 and includes a waste outlet 91 for discharging the dust accumulated in the dust collecting chamber 73, and a waste-outlet lid 92 that opens and closes the waste outlet 91.

The primary dust container 13 includes a suction port 93 that introduces air directly from the outside of the air passage including the primary dust container 13 by the negative pressure generated by the secondary electric blower 49 of the station 2, and a suction-port lid 94 that opens and closes the suction port 93.

The primary dust container 13 further includes a dust-removal mechanism 95 that removes the dust attached to the filter 69 (i.e., dust attached to the filters 86 and 87), and a power transmission mechanism 96 that links the dust-removal operation of the dust-removal mechanism 95 with the opening operation of the waste-outlet lid 92.

The container body 78 accommodates the separation unit 64, i.e., the first separator 68 and the filter 69. The container body 78 partitions the dust collecting chamber 73, i.e., the coarse-dust collecting chamber 71 and the filter chamber 72.

Additionally, the container body 78 partitions a machine chamber 97 that accommodates the power transmission mechanism 96. The container body 78 is cylindrical as a whole. The container body 78 is attached to the region A1 such that the centerline of its cylindrical body is directed in the width direction of the body housing 11.

The waste outlet 91 and the suction port 93 are provided on the side surface of the container body 78. The suction-port lid 94 and the waste-outlet lid 92 are opened and closed together. The waste outlet 91 is closed with the waste-outlet lid 92 except when moving dust from the cleaner body 7 to the station 2. The suction port 93 is closed with the suction-port lid 94 except when moving dust from the cleaner body 7 to the station 2.

The waste outlet 91 discharges the dust accumulated in the primary dust container 13 together with the air introduced from the suction port 93. The waste outlet 91 is disposed at the rear end portion of the body housing 11. The waste outlet 91 is disposed at the position where the station 2 and the cleaner body 7 are in contact with each other. That is, the waste outlet 91 is disposed on the back surface of the body housing 11. The back surface of the body housing 11 is located at the lower end portion of the body housing 11 in the storage configuration (FIG. 2) of the electric vacuum cleaner device 1. The waste outlet 91 is disposed below the filter 69 in the storage configuration of the electric vacuum cleaner device 1.

At the rear end portion of the body housing 11, a body-housing waste-outlet 98 larger than the waste outlet 91 is provided. The body-housing waste-outlet 98 allows the dust transfer tube 43 of the station 2 pass through it in the storage configuration of the electric vacuum cleaner device 1, and connects an inlet of the dust transfer tube 43 to the waste outlet 91.

The waste outlet 91 includes a coarse-dust waste-outlet 101 connected to the coarse-dust collecting chamber 71, and a fine-dust waste-outlet 102 connected to the filter chamber 72. The coarse-dust waste-outlet 101 and the fine-dust waste-outlet 102 are aligned in the width direction of the body housing 11, i.e., in the direction of the centerline of the container body 78. The coarse-dust collecting chamber 71 and the filter chamber 72 share the partition wall 83 in the vicinity of the waste outlet 91 and are adjacent to each other.

The waste-outlet lid 92 and the suction-port lid 94 are a part of the side surface of the container body 78. The suction-port lid 94 is provided so as to be able to reciprocate in the circumferential direction of the cylindrical container body 78. The waste-outlet lid 92 is supported on the container body 78 with a non-illustrated hinge mechanism. The waste-outlet lid 92 opens and closes the coarse-dust waste-outlet 101 and the fine-dust waste-outlet 102 together. When the waste-outlet lid 92 is opened, both of the coarse-dust waste-outlet 101 and the fine-dust waste-outlet 102 are connected to the dust transfer tube 43 together.

In addition, a packing 103 is appropriately provided in the waste outlet 91. The packing 103 is an integral molding. The packing 103 is sandwiched between the waste-outlet lid 92 and the container body 78, and seals both of the coarse-dust waste-outlet 101 and the fine-dust waste-outlet 102 together.

The suction port 93 is an inlet for introducing air into the filter chamber 72 from the outside of the cleaner body 7 or from the outside of the air passage that is inside the body housing 11 and connected to the primary electric blower 15. The suction port 93 is a suction inlet that generates an air flow when the dust is moved from the cleaner body 7 to the station 2.

As viewed in the circumferential direction of the container body 78, the suction port 93 is disposed at the position farthest from the waste outlet 91, i.e., the position 180° away from the waste outlet 91. In other words, when the centerline of the container body 78 is used as a reference, the position of the suction port 93 is in line symmetry with the position of the waste outlet 91. That is, the suction port 93 is disposed above the filter 69 in the storage configuration (FIG. 1) of the electric vacuum cleaner device 1. In other words, the filters 86 and 87 are disposed between the suction port 93 and the waste outlet 91.

The suction port 93 is disposed in the air passage on the upstream of the filters 86 and 87 (i.e., upstream of the flow generated by the primary electric blower 15).

The air introduced from the suction port 93 causes both of the fine dust filtered with the filters 86 and 87 and the coarse dust accumulated in the primary dust container 13 to flow out from the waste outlet 91 together. When the negative pressure acts on the filter chamber 72 from the dust transfer tube 43 through the fine-dust waste-outlet 102, the suction port 93 blows air on the filters 86 and 87. The air blown on the filters 86 and 87 blows off the dust captured on the surfaces of the filters 86 and 87 so as to lead the dust to the fine-dust waste-outlet 102. The filters 86 and 87 have the ridge lines 86*a* and 87*a* extending in the vertical direction in dust removal, i.e., in the storage configuration of the electric vacuum cleaner device 1, and the end face intersecting the fold is opened. Thus, the air blown on the filters 86 and 87 can easily flow along the fold, and the separated fine dust can be made to flow out smoothly from the end portion of the fold.

At this time, the negative pressure acts also on the coarse-dust collecting chamber 71 from the dust transfer tube 43 through the coarse-dust waste-outlet 101. Since the coarse-dust collecting chamber 71 is directly connected to the filter chamber 72, and is indirectly connected to the filter chamber 72 via the first separator 68, a part of the air flowing in from the suction port 93 also flows into the coarse-dust collecting chamber 71. The air having flowed into the coarse-dust collecting chamber 71 causes the coarse dust accumulated in the coarse-dust collecting chamber 71 to flow out of (i.e., be discharged from) the coarse-dust waste-outlet 101.

Although the suction port 93 according to the present embodiment is provided in the container body 78 of the primary dust container 13 and is disposed in the air passage on the upstream of the filters 86 and 87, the suction port 93 may be provided in the air passage on the downstream of the filters 86 and 87 (i.e., downstream of the flow generated by the primary electric blower 15) as shown by the suction port 93 and the suction-port lid 94 indicated by the two-dot chain lines in FIG. 6. In this case, the suction port 93 communicates with the air passage from the filters 86 and 87 to the primary electric blower 15, e.g., communicates with the communication passage 66.

The rechargeable battery 17 surrounds the coarse-dust collecting chamber 71. That is, the plural unit cells 17*a* included in the rechargeable battery 17 are arranged along the inner surface of the rear half of the cylindrical body housing 11 and surround the periphery of the coarse-dust collecting chamber 71.

Next, the dust-removal mechanism 95 of the vacuum cleaner 3 according to the present embodiment will be described.

Figure 8:
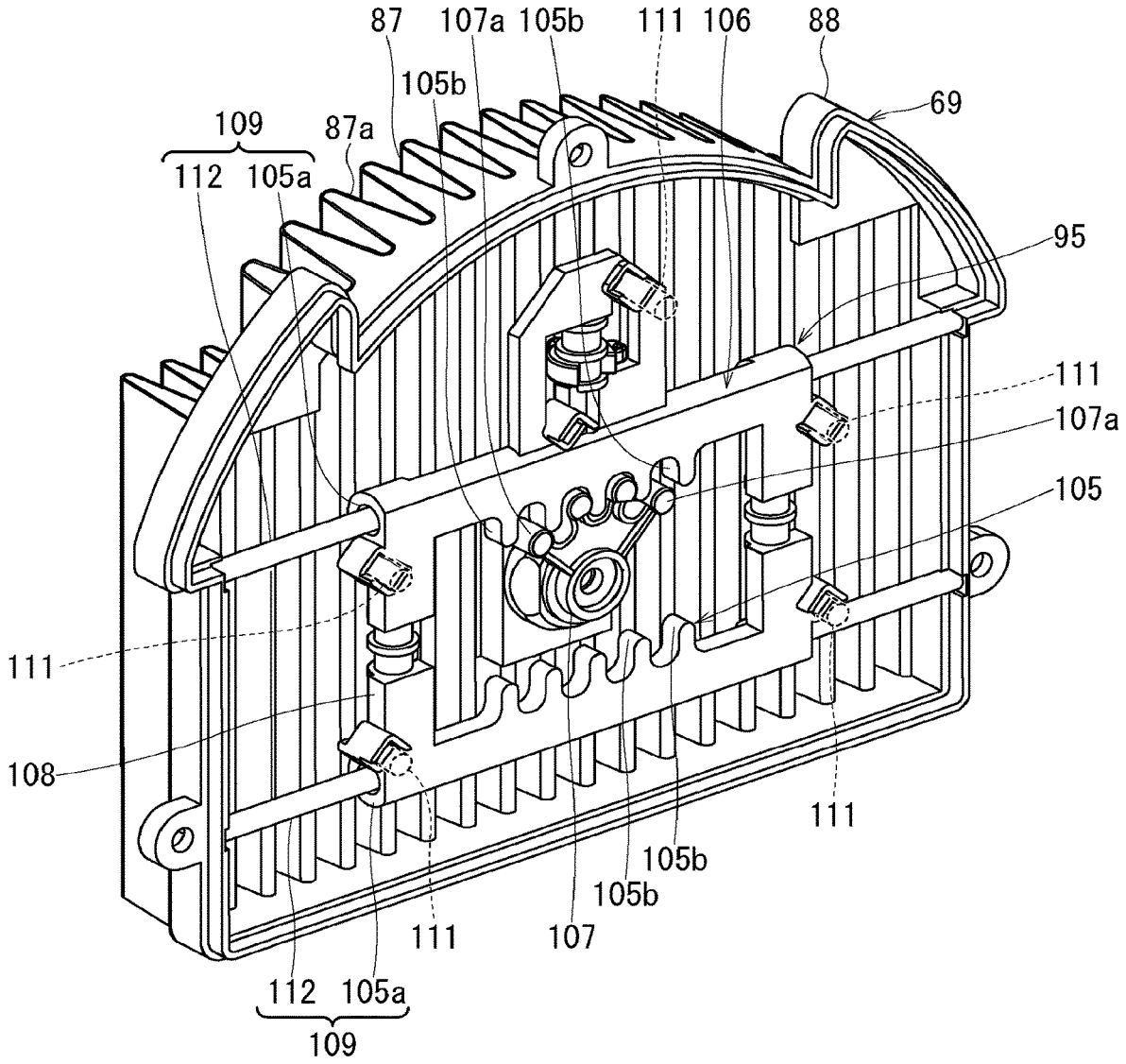
FIG. 8 is a perspective view of a dust-removal mechanism of the vacuum cleaner according to the embodiment of the present invention.

FIG. 8 is a perspective view of the dust-removal mechanism of the vacuum cleaner according to the embodiment of the present invention.

As shown in FIG. 8, the dust-removal mechanism 95 of the vacuum cleaner 3 according to the present embodiment is disposed between the pair of filters 86 and 87. In other words, the dust-removal mechanism 95 is disposed in the internal space of the filter 69. The dust-removal mechanism 95 removes the dust from the pair of filters 86 and 87 together.

The dust-removal mechanism 95 includes a driven unit 106 equipped with plural connected racks 105 and a gear 107 that sequentially meshes with the plural racks 105 so as to move the driven unit 106 along a predetermined track while rotating in one direction.

In addition to the plural racks 105, the driven unit 106 is further equipped with a frame 108 that integrally connects the plural racks 105, a mechanism (e.g. slider 109) that defines the moving direction of the racks 105, and dust removers 111 that contact the respective filters 86 and 87.

The plural racks 105 in the present embodiment are a pair of racks 105 arranged in parallel. The driven unit 106 reciprocates by alternately meshing the gear 107 with the pair of racks 105.

The frame 108 connects the respective ends of the pair of racks 105. The pair of racks 105 and the frame 108 draw a rectangle as a whole.

The slider 109 includes holes 105*a* of the racks 105 and rod-like rails 112 that are inserted into the corresponding holes 105*a* and fixed to the secondary filter frame 88 of the filter 69. The slider 109 may be configured as a component that includes elongated holes provided in the frame 108 or the racks 105 and pin members such as screws or rivets to be inserted into the elongated holes and fixed to the secondary filter frame 88, for instance.

The gear 107 is disposed at the central portion of the filter 69. In other words, the gear 107 is sandwiched between the pair of filters 86 and 87 and disposed at the central portion of the projection surface of the filters 86 and 87.

The teeth 107*a* of the gear 107 are partially provided. In other words, the gear 107 is partially devoid of the teeth 107*a*. The teeth 107*a* of the gear 107 sequentially mesh with the plural racks 105 in the process of one rotation of the gear 107. The number of teeth 107*a* of the gear 107 is limited to a range in which two or more racks 105 do not simultaneously mesh with the gear 107.

More specifically, the number of teeth 105*b* of each rack 105 is one more than the number of the teeth 107*a* of the gear 107. That is, the number of grooves between the adjacent teeth 105*b* of each rack 105 is the same as the number of the teeth 107*a* of the gear 107. For instance, the gear 107 has four teeth 107*a* and each rack 105 has five teeth 105*b*. The distance from the bottom of the groove of one of the pair of racks 105 to the bottom of the groove of the other of the pair of racks 105 is slightly larger than the outermost diameter of the gear 107. This difference (gap) facilitates engagement and disengagement between the teeth 107*a* of the gear 107 and the teeth 105*b* of the racks 105.

While the gear 107 partially devoid of the teeth 107*a* rotates half, the teeth 107*a* mesh with one of the racks 105 to move the driven unit 106 in the forward path. When the rotation of the gear 107 progresses (advances about 180°), the teeth 107*a* come out of the one rack 105 and mesh with the other rack 105 so as to move the driven unit 106 in the backward path. The gear 107 may be configured such that there is a period in which the teeth 107*a* are not temporarily engaged with any of the racks 105 between the forward path and the backward path of the driven unit 106.

The dust-removal mechanism 95 having three or more racks 105 may include a gear 107 equipped with teeth around its entire circumference, and a mechanism for defining the moving direction of the racks 105 other than the slider 109. The dust-removal mechanism 95 having three or more racks 105 may cause the gear 107 to make one or more rotations when causing the driven unit 106 to move along its track for one cycle.

Next, the power transmission mechanism 96 of the vacuum cleaner 3 according to the present embodiment will be described.

FIG. 9 to FIG. 12 are schematic diagrams illustrating the power transmission mechanism of the vacuum cleaner according to the embodiment of the present invention.

Figure 9:
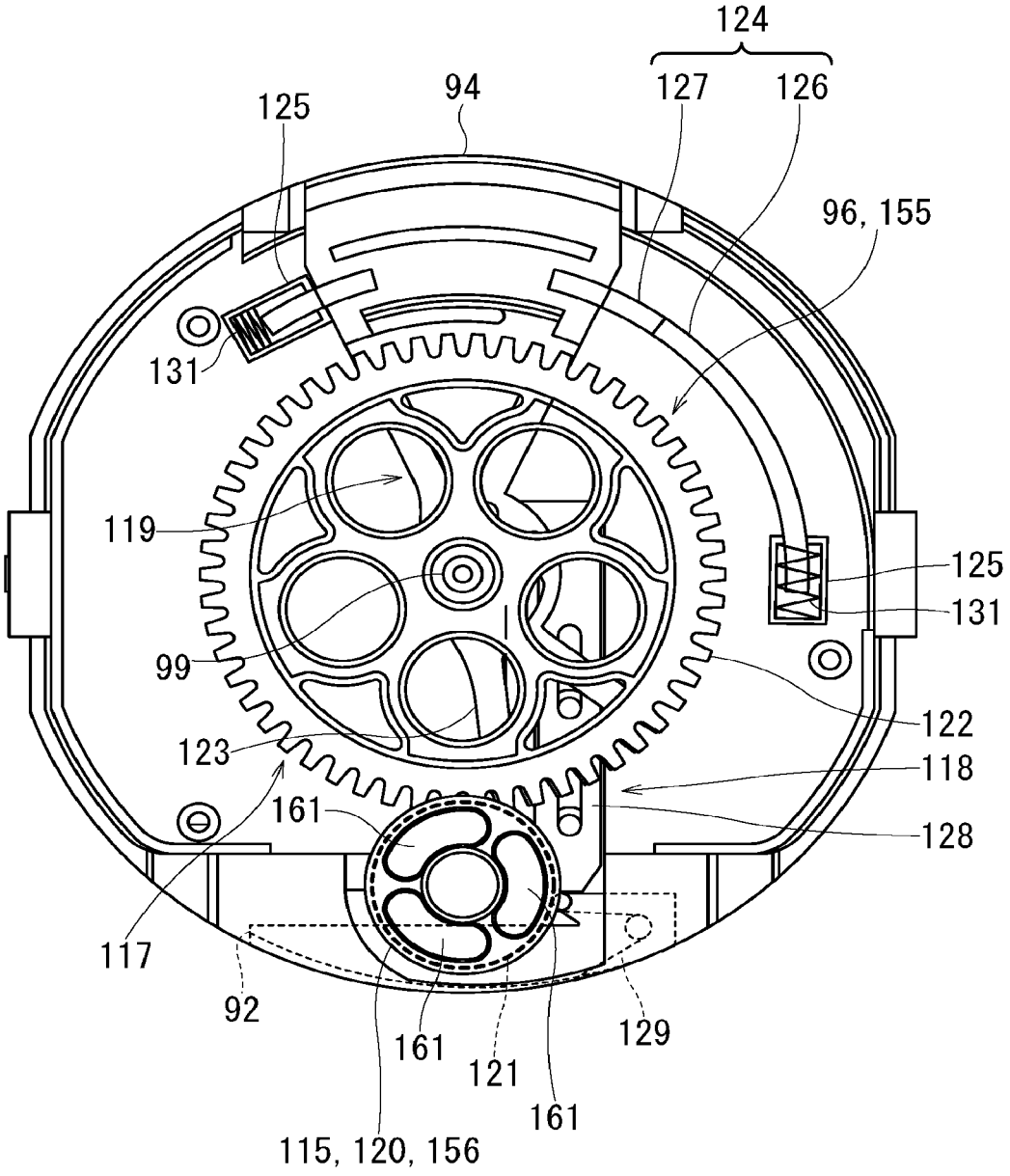
FIG. 9 is a schematic diagram illustrating a power transmission mechanism of the vacuum cleaner according to the embodiment of the present invention.
Figure 10:
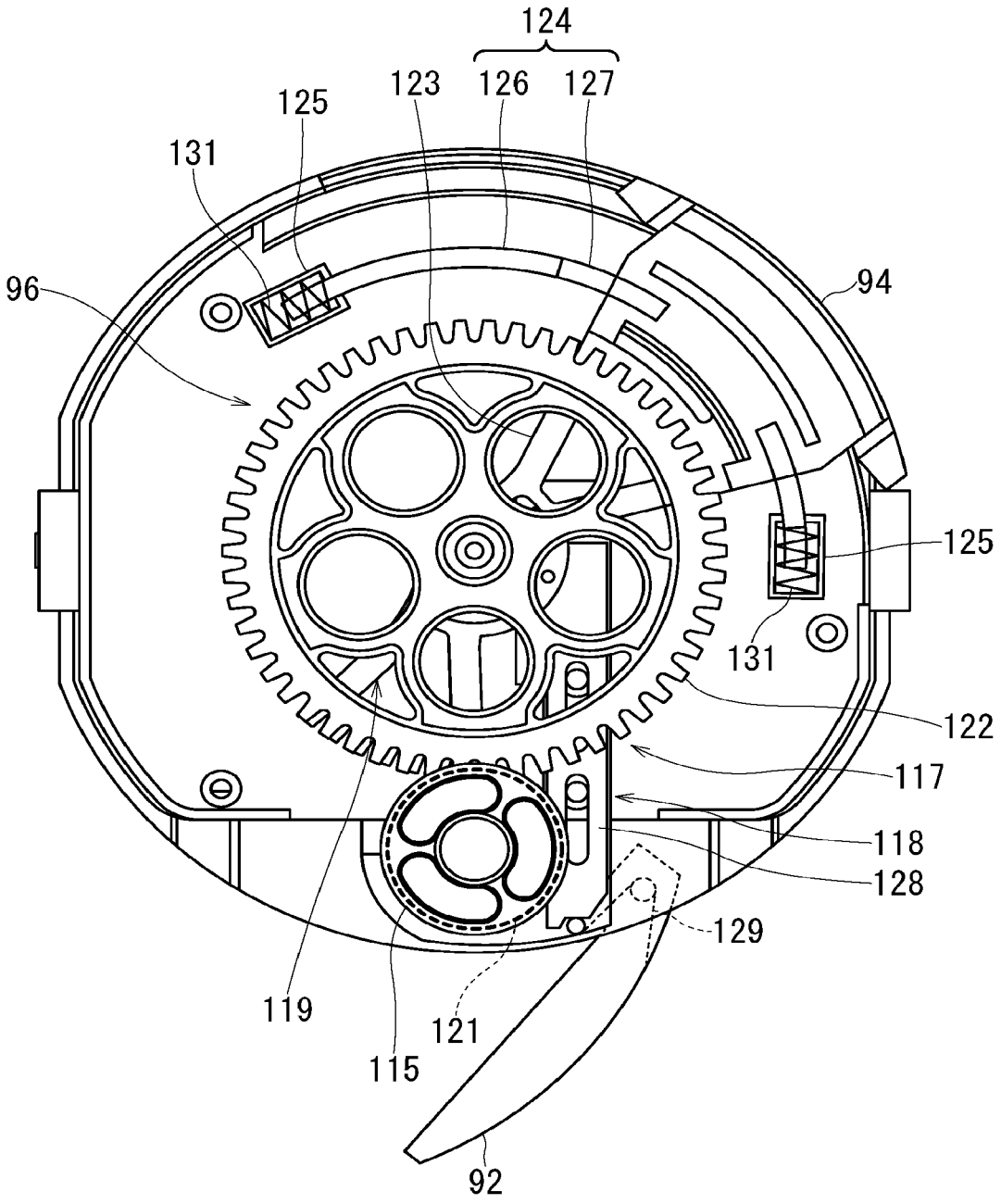
FIG. 10 is another schematic diagram illustrating the power transmission mechanism of the vacuum cleaner according to the embodiment of the present invention.
Figure 11:
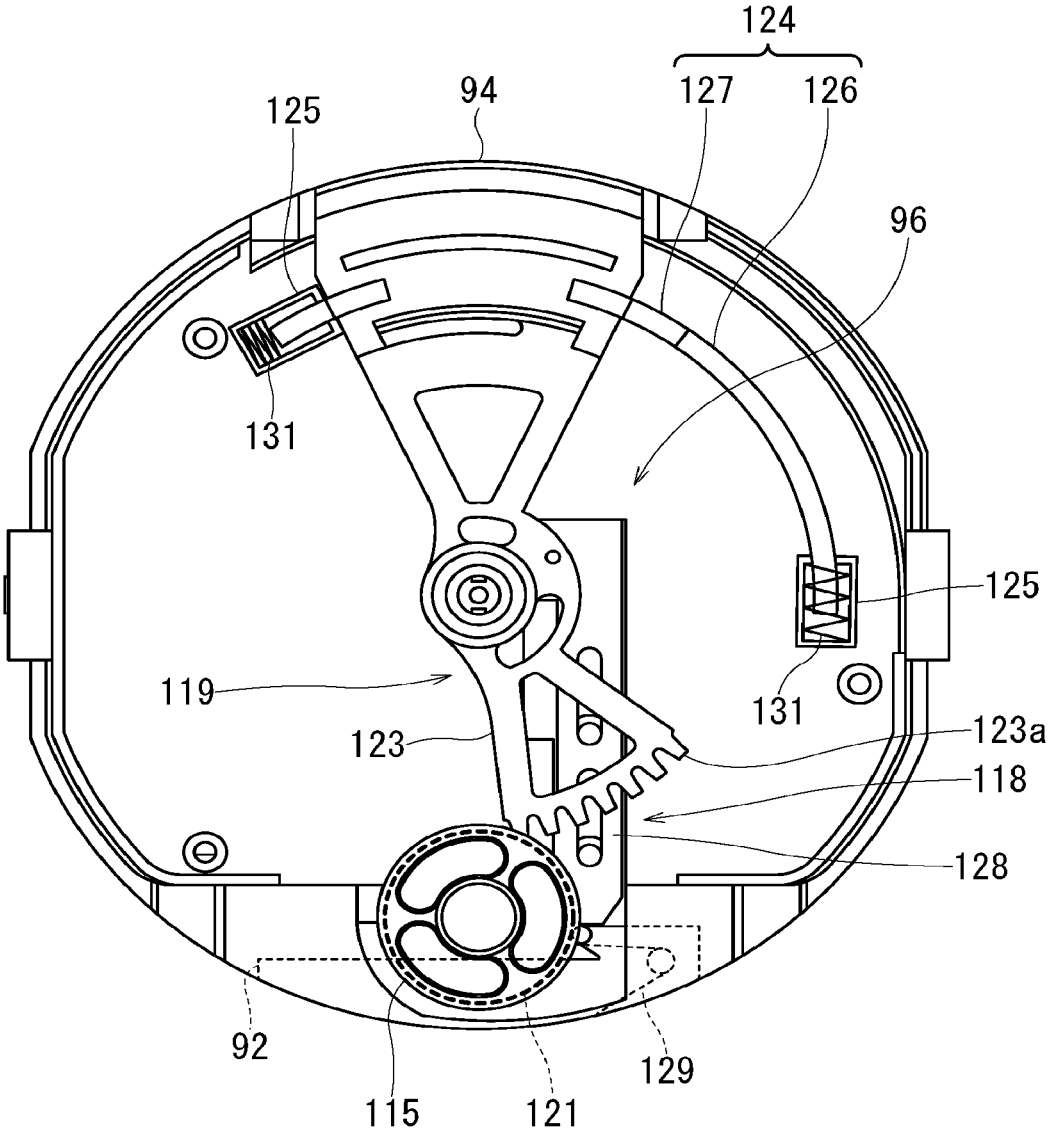
FIG. 11 is still another schematic diagram illustrating the power transmission mechanism of the vacuum cleaner according to the embodiment of the present invention.
Figure 12:
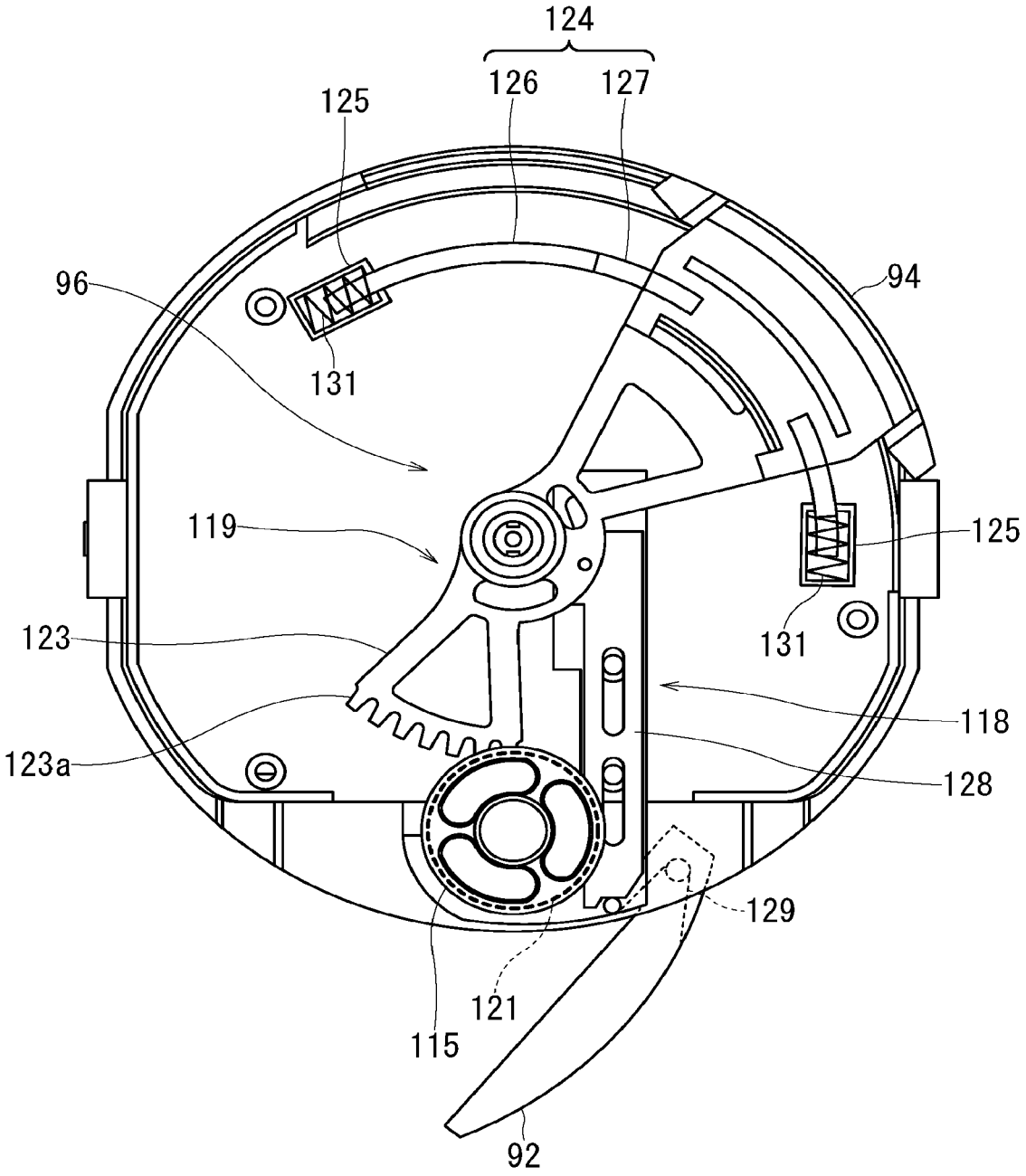
FIG. 12 is still another schematic diagram illustrating the power transmission mechanism of the vacuum cleaner according to the embodiment of the present invention.

FIG. 9 and FIG. 11 show when the waste-outlet lid 92 and the suction-port lid 94 are closed with the power transmission mechanism 96. FIG. 10 and FIG. 12 show when the waste-outlet lid 92 and the suction-port lid 94 are opened with the power transmission mechanism 96. FIG. 11 and FIG. 12 show the power transmission mechanism 96 with the second gear 122 omitted.

As shown in FIG. 9 to FIG. 12 in addition to FIG. 3 and FIG. 5, the power transmission mechanism 96 of the vacuum cleaner 3 according to the present embodiment receives the driving force for the dust-removal mechanism 95, the waste-outlet lid 92, and the suction-port lid 94 from the station 2, and distributes and transmits the driving force to each of the dust-removal mechanism 95, the waste-outlet lid 92, and suction-port lid 94. The power transmission mechanism 96 includes a driven part 115, a first transmission mechanism 117 for transmitting the driving force from the driven part 115 to the dust-removal mechanism 95, a second transmission mechanism 118 for transmitting the driving force from the driven part 115 to the waste-outlet lid 92, and a third transmission mechanism 119 for transmitting the driving force from the driven part 115 to the suction-port lid 94.

The driven part 115 is a part of a coupling 120 that transmits rotational driving force. The driven part 115 is engageable, connectable, and couplable to a driving part 116 of the coupling 120 of the station 2.

The first transmission mechanism 117 always transmits the driving force inputted to the driven part 115 to the gear 107 of the dust-removal mechanism 95. The first transmission mechanism 117 simply transmits the rotational driving force inputted to the driven part 115 so as to rotate the gear 107. In other words, the first transmission mechanism 117 rotates the gear 107 in the reverse direction when the driven part 115 rotates in the normal direction, and the first transmission mechanism 117 rotates the gear 107 in the normal direction when the driven part 115 rotates in the reverse direction.

The first transmission mechanism 117 includes a first gear 121 rotationally integral with the driven part 115, and a second gear 122 engaged with the first gear 121 and having a large diameter. The second gear 122 penetrates the secondary filter frame 88 of the filter 69, and is rotatably supported with a shaft 99 that rotates integrally with the gear 107 of the dust-removal mechanism 95. That is, the second gear 122 and the gear 107 of the dust-removal mechanism 95 rotate integrally. The second gear 122 having a larger diameter than the first gear 121 can drive the dust-removal mechanism 95, which operates while flipping or deforming the filters 86 and 87, with a motor of smaller output (a drive source 149 of the station 2 described below).

The second transmission mechanism 118 opens and closes the waste-outlet lid 92 by the driving force inputted to the driven part 115. The third transmission mechanism 119 opens and closes the suction-port lid 94 by the driving force inputted to the driven part 115. Both of the suction-port lid 94 and the waste-outlet lid 92 are opened and closed together. In other words, when the second transmission mechanism 118 opens the waste-outlet lid 92, the third transmission mechanism 119 also opens the suction-port lid 94. In addition, when the second transmission mechanism 118 closes the waste-outlet lid 92, the third transmission mechanism 119 also closes the suction-port lid 94.

The third transmission mechanism 119 includes the first gear 121 that is shared with the first transmission mechanism 117, a lever 123 that is equipped with teeth 123*a* disposed in an arc and engaged with the first gear 121, a guide unit 124 that guides the swing of the lever 123, and a pair of stoppers 125 that defines the swinging range of the lever 123.

The lever 123 has a rocking center that coincides with the rotation center of the second gear 122. That is, the lever 123 is supported along with the second gear 122 with a shaft rotatably supporting the second gear 122. The lever 123 is directly connected to the suction-port lid 94.

The guide unit 124 includes a groove 126 provided in the container body 78, and a guide plate 127 disposed in the groove 126. The groove 126 extends in an arc according to the swinging track of the lever 123. The guide plate 127 is integrated into the lever 123.

The stoppers 125 regulate and limit the swinging range of the lever 123 in accordance with the fully closed position and the fully open position of the waste-outlet lid 92 and the suction-port lid 94.

The second transmission mechanism 118 includes: the first gear 121 that is shared with the first transmission mechanism 117 and the third transmission mechanism 119; the lever 123, the guide unit 124, and the stoppers 125 that are shared with the third transmission mechanism 119; a slider 128 that converts the swinging motion of the lever 123 into a reciprocating motion and transmits it to the waste-outlet lid 92; and a waste-lid closing spring 129 that closes spring 129 generates spring force for fully closing the waste-outlet lid 92. The slider 128 overcomes the spring force of the waste-lid closing spring 129 so as to open the waste-outlet lid 92. In addition, the slider 128 closes the waste-outlet lid 92 by the spring force of the waste-lid closing spring 129.

The power transmission mechanism 96 transmits the driving force from the station 2 to the dust-removal mechanism 95 for an arbitrary period. After the waste-outlet lid 92 and the suction-port lid 94 are fully opened or fully closed, the power transmission mechanism 96 disengages (i.e., cuts off) the power transmission from the station 2 to the waste-outlet lid 92 and the suction-port lid 94 even in an arbitrary period during which the dust-removal mechanism 95 is in operation.

That is, the second transmission mechanism 118 disengages the transmission of the driving force from the driven part 115 to the waste-outlet lid 92 when the waste-outlet lid 92 is fully opened or fully closed. Additionally, the third transmission mechanism 119 disengages the transmission of the driving force from the driven part 115 to the suction-port lid 94 when the suction-port lid 94 is fully opened or fully closed.

Specifically, the second transmission mechanism 118 and the third transmission mechanism 119 release the engagement between the teeth 123*a* of the lever 123 and the first gear 121 when the waste-outlet lid 92 and the suction-port lid 94 are fully opened or fully closed. That is, the arrangement range of the teeth 123*a* arranged in an arc is provided and limited in such a manner that the teeth 123*a* are disengaged from the first gear 121 when the waste-outlet lid 92 and the suction-port lid 94 are fully opened or fully closed.

When the waste-outlet lid 92 is fully closed or fully opened, the teeth 123*a* of the lever 123 cannot resist the waste-outlet lid 92 which is prevented from moving, and is disengaged from the first gear 121 so as to interrupt the transmission of the driving force (torque). When the suction-port lid 94 is fully closed or fully opened, the teeth 123*a* of the lever 123 is disengaged from the first gear 121 so as to interrupt the transmission of the driving force (torque).

The power transmission mechanism 96 includes a drive source, for example, a return spring 131 for promoting smooth engagement between the teeth 123*a* of the lever 123 and the first gear 121 when the engagement between both is restored. When the waste-outlet lid 92 and the suction-port lid 94 are fully opened or fully closed, the return spring 131 is compressed to store energy. Additionally, when opening or closing of the waste-outlet lid 92 and the suction-port lid 94 is started, the return spring 131 pushes back the lever 123 by consuming the energy so as to assist in the return of the engagement between the teeth 123*a* of the lever 123 and the first gear 121.

It is preferable that the waste-outlet lid 92 and the suction-port lid 94 maintain the fully open state while the dust-removal mechanism 95 operates and removes the dust from the filters 86 and 87 for an appropriate period. It is not preferable that the dust-removal mechanism 95 is caused to reciprocate by switching between the normal rotation and the reverse rotation of the motor (i.e., the drive source 149 of the station 2 described below), since the waste-outlet lid 92 and the suction-port lid 94 are opened and closed whenever the normal rotation and the reverse rotation of the motor are switched. For this reason, the dust-removal mechanism 95 according to the present embodiment is configured to be capable of reciprocating the driven unit 106 with the gear 107 rotating in one direction.

Next, the station 2 according to the embodiment of the present invention will be described in detail.

Figure 13:
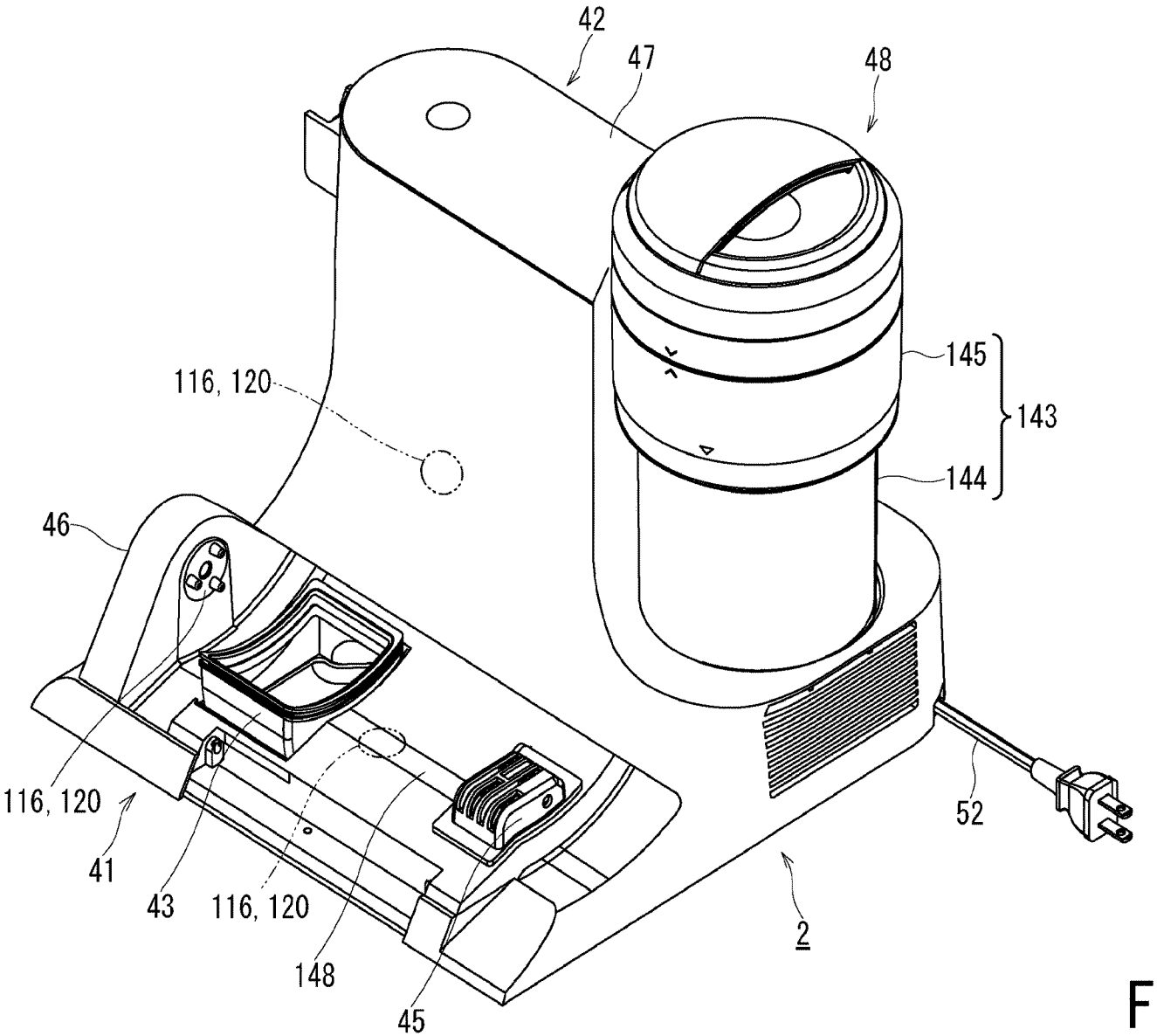
FIG. 13 is a perspective view of a station of the electric vacuum cleaner device according to the embodiment of the present invention.
Figure 14:
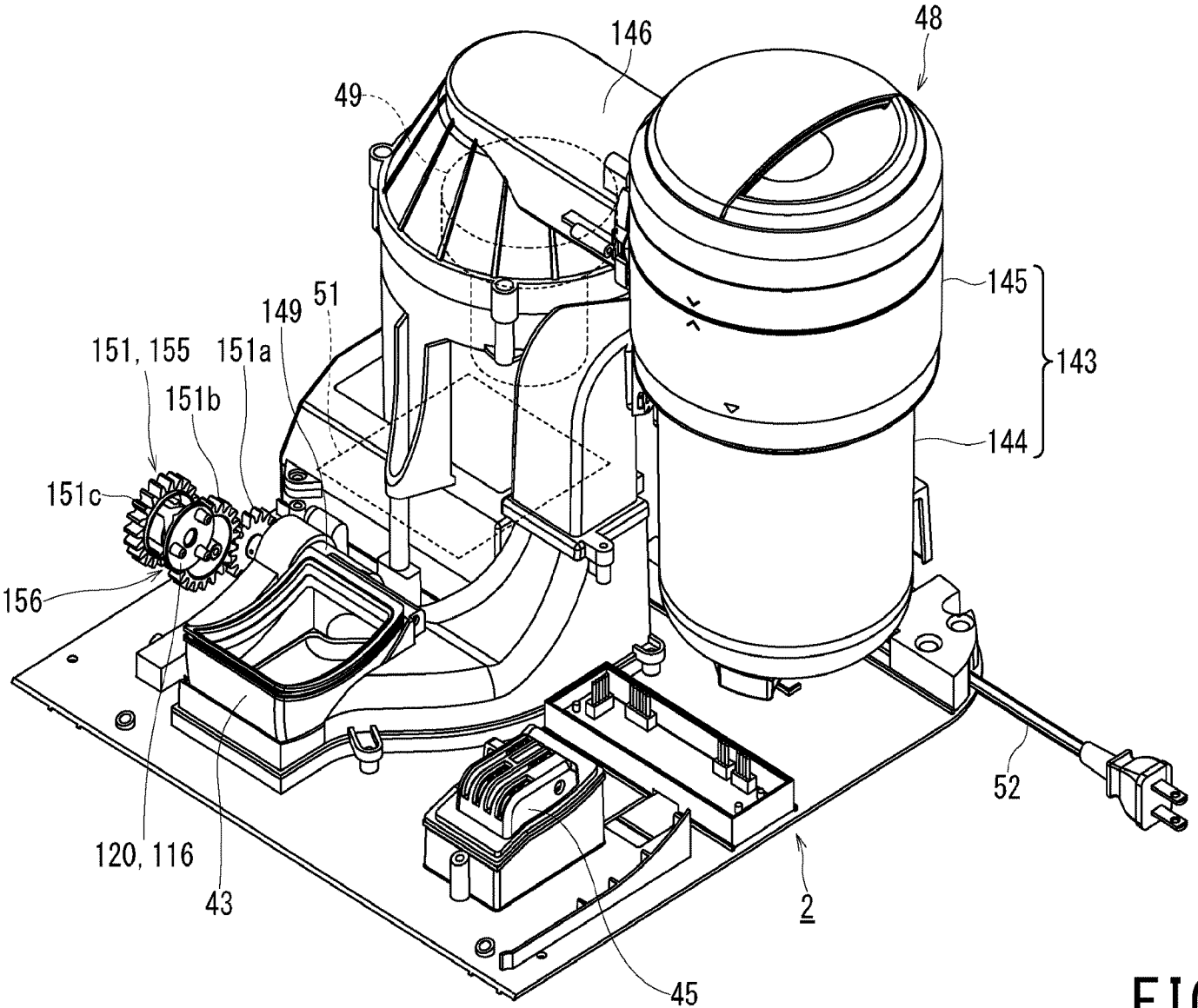
FIG. 14 is another perspective view of the station of the electric vacuum cleaner device according to the embodiment of the present invention.

FIG. 13 and FIG. 14 are perspective views of the station of the electric vacuum cleaner device according to the embodiment of the present invention.

FIG. 14 is a perspective view of the top plate of the platform 41 and the station 2 from which the housing 47 of the dust collection unit 142 is detached.

As shown in FIG. 13 and FIG. 14, the secondary dust container 48 of the station 2 according to the present embodiment includes a centrifugal separation unit 143 for centrifuging the dust flowing from the dust transfer tube 43 from the air. The centrifugal separation unit 143 is a multistage type, and includes a first centrifugal separator 144 for centrifuging the dust flowing from the dust transfer tube 43 from the air and a second centrifugal separator 145 for centrifuging the dust passing through the first centrifugal separator 144 from the air.

The first centrifugal separator 144 centrifuges coarse dust out of the dust flowing into the secondary dust container 48. The second centrifugal separator 145 centrifuges fine dust passing through the first centrifugal separator 144. The coarse dust is dust with a large mass such as sand grain and fibrous dust including lint and cotton dust, and the fine dust is particulate or powdery dust with a small mass.

The secondary electric blower 49 is connected to the secondary dust container 48 via a downstream air duct 146. The secondary electric blower 49 generates the negative pressure to the primary dust container 13 via the downstream air duct 146, the secondary dust container 48, and the dust transfer tube 43 so as to move the dust accumulated in the primary dust container 13 to the secondary dust container 48 together with the air.

In addition, the station 2 includes a connection guide 148 provided on the platform 41, the drive source 149 for generating opening drive force and closing drive force of the waste-outlet lid 92 of the primary dust container 13 of the vacuum cleaner 3, and a power transmission mechanism 151 for transmitting the driving force from the drive source 149 to the vacuum cleaner 3.

When the cleaner body 7 is connected to the station 2, the connection guide 148 guides the cleaner body 7 to the position where the charging terminal 45 of the station 2 is suitably connected to the charging electrodes 19 of the cleaner body 7 and the dust transfer tube 43 is suitably connected to the waste outlet 91 of the cleaner body 7.

The storage configuration of electric vacuum cleaner device 1 is the configuration in which the cleaner body 7 is connected to the station 2, the charging terminal 45 of the station 2 is suitably connected to the charging electrodes 19 of the cleaner body 7, and the dust transfer tube 43 is suitably connected to the waste outlet 91 of the cleaner body 7.

The connection guide 148 is recessed so as to conform to the shape of the rear end portion of the body housing 11 of the cleaner body 7. That is, the connection guide 148 fits in the cylindrical rear half of the body housing 11 and is recessed in an arc in a side view of the station 2. When the cleaner body 7 is lowered from above the platform 41 and connected to the station 2, the connection guide 148 conforming to the shape of the rear end portion of the cleaner body 7 ensures the positioning of the cleaner body 7 in the storage configuration of the electric vacuum cleaner device 1.

The charging terminal 45 and the inlet of the dust transfer tube 43 are disposed in the connection guide 148.

The drive source 149 is, e.g., an electric motor. The drive source 149 is electrically connected to the station controller 51. The drive source 149 is controlled with the station controller 51 in a manner similar to the secondary electric blower 49.

The drive source 149 generates the opening drive force and the closing drive force of the suction-port lid 94 of the vacuum cleaner 3. The drive source 149 generates the driving force of the dust-removal mechanism 95 of the vacuum cleaner 3. That is, the drive source 149 generates the driving force of the waste-outlet lid 92, the suction-port lid 94, and the dust-removal mechanism 95. The drive source 149 is provided between the inlet of the dust transfer tube 43 and the dust collection unit 142.

The power transmission mechanism 151 is an appropriate mechanism for transmitting the power of the drive source 149 from the drive source 149, i.e., from the output shaft of the electric motor to the centerline of the driven part 115 of the cleaner body 7 in the storage configuration of the electric vacuum cleaner device 1. The power transmission mechanism 151 according to the present embodiment includes plural, e.g., three gears 151*a*, 151*b*, and 151*c* that are meshed with each other, and a non-illustrated gear box that rotatably supports and accommodates these gears 151*a*, 151*b*, and 151*c*. The power transmission mechanism 151 may be a mechanism combining pulleys and a belt or be a mechanism combining sprockets and a chain.

Next, a description will be give of the drive transmission passage for transmitting the driving force of the drive source 149 from the station 2 to the cleaner body 7.

Figure 15:
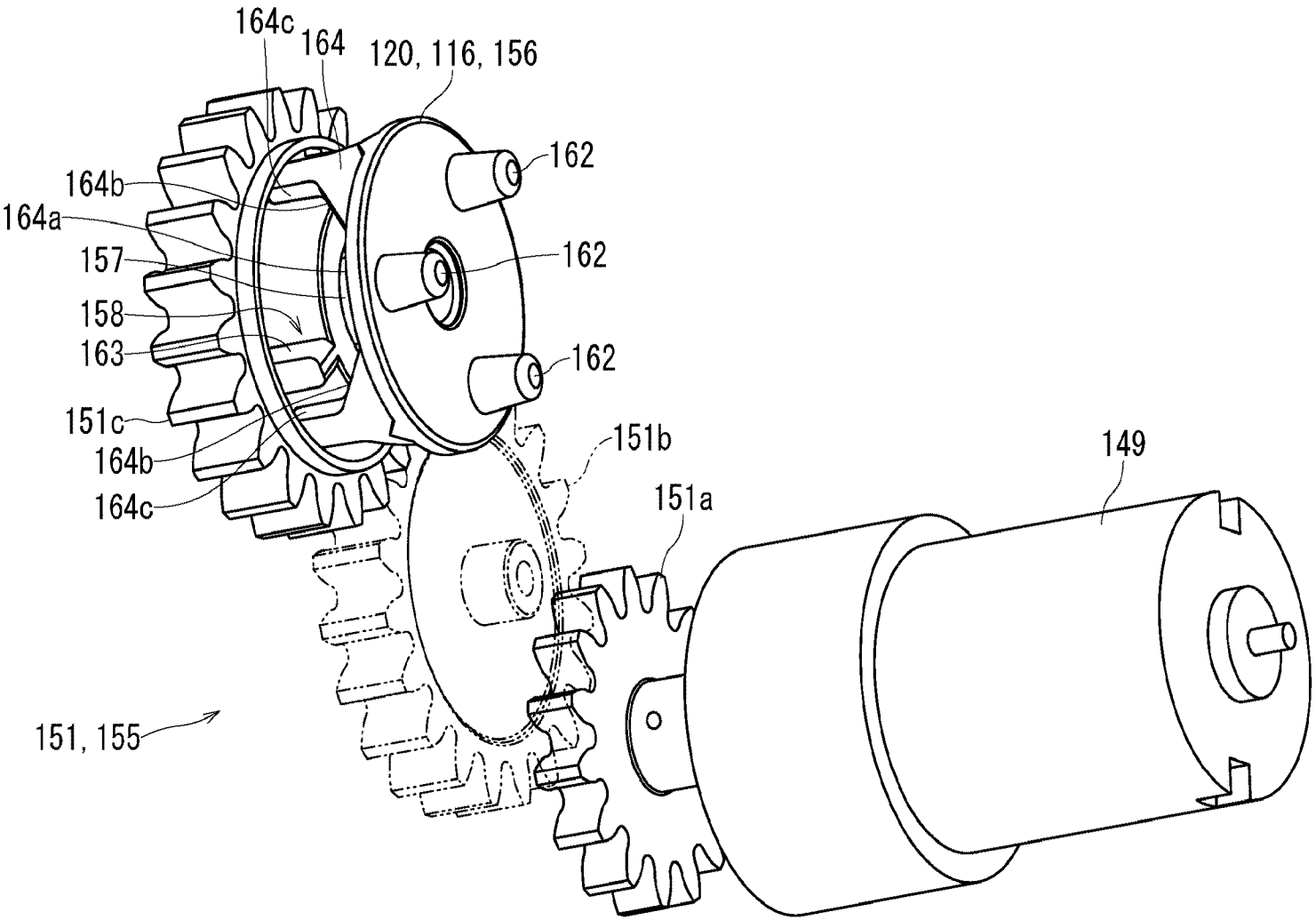
FIG. 15 is a perspective view of a power transmission passage of the electric vacuum cleaner device according to the embodiment of the present invention.

FIG. 15 is a perspective view of the power transmission passage of the electric vacuum cleaner device according to the embodiment of the present invention.

FIG. 15 shows only the side of the station 2 in a power transmission passage 155, i.e., the power transmission mechanism 151 of the station 2.

As shown in FIG. 15 in addition to FIG. 9 and FIG. 14, the electric vacuum cleaner device 1 according to the present embodiment includes the power transmission passage 155 that transmits the driving force from the drive source 149 of the station 2 to the waste-outlet lid 92 of the cleaner body 7, and a coupler 156 that engages and disengages the power transmission passage 155 between the station 2 and the vacuum cleaner 3.

The power transmission passage 155 includes the power transmission mechanism 96 on the vacuum cleaner 3, and the power transmission mechanism 151 on the station 2. The coupler 156 causes the power transmission passage 155 to function by coupling the power transmission mechanism 96 on the vacuum cleaner 3 to the power transmission mechanism 151 on the station 2.

The coupler 156 except the power transmission mechanism 151 and the driven part 115 of the cleaner body 7 is covered with the bulge 46 of the platform 41. The bulge 46 accommodates the driving part 116 such that the driving part 116 can appear and hide.

The coupler 156 includes the shaft coupling 120, a drive source that generates power for disengaging the coupling 120 (e.g., a disengaging spring 157), and a cam mechanism 158 that engages the coupling 120 by the driving force generated with the drive source 149. The coupler 156 engages the driving part and the driven part of the coupling 120 by the driving force of the drive source 149, and disengages the driving part and the driven part of the coupling 120 by the spring force of the disengaging spring 157.

The coupling 120 is a so-called dog clutch or pin type flange coupling. The coupling 120 includes the driven part 115 provided in the power transmission mechanism 96 of the vacuum cleaner 3, and the driving part 116 provided in the power transmission mechanism 151 of the station 2.

The driven part 115 includes plural arc-shaped grooves 161 that are circularly arranged. The driving part 116 includes plural pins 162 that are circularly arranged. Each of the pins 162 has a diameter by which each pin 162 can enter and exit each arc-shaped groove 161. Each pin 162 is preferably tapered to facilitate insertion into each arc-shaped groove 161.

The driving part 116 always rotates by the driving force transmitted by the power transmission mechanism 151. When the coupling 120 is engaged, the driven part 115 rotates together with the driving part 116. The driving part 116 protrudes from the bulge 46 of the station 2 so as to be coupled to the driven part 115. The driving part 116 protrudes from the bulge 46 disposed to the side of the cleaner body 7 in the width direction of the cleaner body 7 so as to be coupled to the driven part 115. In other words, when the cleaner body 7 is detached from the station 2 and when the cleaner body 7 is returned to the station 2, the coupler 156 engages the coupling 120 by bringing the driving part 116 into and out of the bulge 46 in the moving direction of the cleaner body 7, i.e., in the direction intersecting with the vertical direction. Accordingly, the coupler 156 can prevent, e.g., dust from intruding into the station 2 from a gap between the bulge 46 and the driving part 116, and thus the coupler 156 can ensure satisfactory operation of the power transmission mechanism 151.

The driving part 116 is not limited to protrude from the bulge 46 in the width direction of the cleaner body 7 and is coupled to the driven part 115. Alternatively, the driving part 116, which indicated by the two-dot chain line in FIG. 13, may be provided so as to protrude from the connection guide 148 and engaged to the driven part 115 at the same time as the cleaner body 7 is connected to the station 2. In addition, the driving part 116, which indicated by the two-dot chain line in FIG. 13, may be disposed in the dust collection unit 42 and protruded in front of the station 2 so as to be coupled to the driven part 115.

The disengaging spring 157 pulls the driving part 116 in the direction by which the driving part of the coupling 120 is disengaged from the driven part of the coupling 120, i.e., in the direction away from the driven part 115. In other words, the disengaging spring 157 pulls in the driving part 116 in the direction to be buried in the bulge 46.

The cam mechanism 158 is provided on the station 2. The cam mechanism 158 is a so-called face cam. The cam mechanism 158 converts the rotational motion of the power transmission mechanism 151 into the linear motion of the driving part 116, i.e., the motion in which the driving part 116 appears from and hides into the bulge 46. As the linear motion of the driving part 116 progresses appropriately, the cam mechanism 158 causes the driving part 116 to rotate. The cam mechanism 158 includes a driving member 163 rotated by the power transmission mechanism 151 and a driven member 164 provided on the driving part 116. The driven member 164 includes a first cam surface 164*a*, a second cam surface 164*b*, and a third cam surface 164*c*. The first cam surface 164*a* is the closest to the shaft 162 of the driving part 116 and extends in the circumferential direction of the driving part 116, i.e., in the direction perpendicular to the rotational centerline of the driving part 116. The second cam surface 164*b* is inclined with respect to the rotational centerline of the driving part 116 and extends in the direction opposite to the shaft 162 of the driving part 116. The third cam surface 164*c* is connected to the top portion of the second cam surface 164*b* and extends in the direction away from the first cam surface 164*a*. The third cam surface 164*c* extends substantially parallel to the rotational centerline of the driving part 116. The driving member 163 is shaped in such a manner that the driving member 163 can be in line contact with the first cam surface 164*a* and the second cam surface 164*b* and can be in surface contact with the third cam surface 164*c*.

When the coupling 120 is disengaged, the coupler 156 places the driving member 163 on the first cam surface 164*a* of the driven member 164 of the cam mechanism 158 or brings the driving member 163 closest to the first cam surface 164*a*. In this state, the driving part 116 is the most intruded into the bulge 46 of the station 2. When the drive source 149 starts up, the driving member 163 rotates together with the gear 115*c* of the power transmission mechanism 151. The rotating driving member 163 moves on the first cam surface 164*a* of the driven member 164, approaches the second cam surface 164*b*, and eventually rides on the second cam surface 164*b*. At this time, the driving part 116 is pushed out of the bulge 46 by the force of the driving member 163 that pushes the second cam surface 164*b*, and is engaged to the driven part 115. As the rotation of the driving part 116 progresses and the driving member 163 comes into surface contact with the third cam surface 164*c*, the entirety of the coupler 156 rotates in synchronization with the driving member 163.

The driving part 116 is pulled into the bulge 46 by the spring force of the disengaging spring 157. This spring force generates appropriate frictional force between the driving member 163 and the driven member 164, and reliably cause the driving member 163 to ride on the second cam surface 164*b* of the driven member 164.

When the driven part 115 of the cleaner body 7 is viewed from the driving part 116 of the station 2, the cam mechanism 158 has the second cam surface 164*b* and the third cam surface 164*c* in both of the direction of the normal rotation direction (clockwise) of the driving part 116 and the reverse rotation direction (counterclockwise) of the driving part 116. In other words, the cam mechanism 158 has a pair of second cam surfaces 164*b* sandwiching the first cam surface 164*a* between them, and also has a pair of third cam surfaces 164*c* sandwiching the first cam surface 164*a* between them.

For instance, it is assumed that the power transmission passage 155 opens the waste-outlet lid 92 and the suction-port lid 94 by rotating the driving part 116 in the normal rotation direction and closes the waste-outlet lid 92 and the suction-port lid 94 by rotating the driving part 116 in the reverse rotation direction. One of the second cam surfaces 164*b* and one of the third cam surfaces 164*c* establish the engagement of the coupler 156 along with the normal rotation of the driving part 116 so as to open the waste-outlet lid 92 and the suction-port lid 94. The other of the second cam surfaces 164*b* and the other of the third cam surfaces 164*c* establish the engagement of the coupler 156 along with the reverse rotation of the driving part 116 so as to close the waste-outlet lid 92 and the suction-port lid 94.

The cleaner body 7 is coupled to the station 2, and thereby the electric vacuum cleaner device 1 is shifted to the storage configuration. At this time, the charging electrodes 19 of the cleaner body 7 contact the charging terminal 45 of the station 2 and are electrically connected to the charging terminal 45. The inlet of the dust transfer tube 43 adheres to the outer surface of the container body 78 of the primary dust container 13 through the body-housing waste-outlet 98 of the cleaner body 7.

The station controller 51 detects that the cleaner body 7 is connected to the station 2, by a detection means such as a non-illustrated charging circuit connected to the charging terminal 45, a non-illustrated contact-type sensor as exemplified by a micro switch, or a non-illustrated non-contact sensor that uses an infrared sensor. When the station controller 51 detects that the cleaner body 7 is connected to the station 2, the station controller 51 starts up the drive source 149 in a timely manner. When the drive source 149 starts up, the driving part 116 of the station 2 protrudes from the bulge 46 and is coupled to the driven part 115 of the cleaner body 7. That is, the engagement of the coupler 156 is established. The station controller 51 continues driving of the drive source 149. The power transmission passage 155 established the engagement of the coupler 156 distributes and transmits the driving forcer of the drive source 149 to the waste-outlet lid 92, the suction-port lid 94, and the dust-removal mechanism 95.

The waste-outlet lid 92 and the suction-port lid 94 are fully opened by the driving force transmitted through the power transmission passage 155. The dust-removal mechanism 95 removes dust adhered to the filters 86 and 87 by the driving force transmitted through the power transmission passage 155. The station controller 51 temporarily stops the drive source 149 for an appropriate period for the dust-removal mechanism 95 to remove fine dust adhered to the filters 86 and 87, e.g., after driving the drive source 149 continuously for 10 seconds.

Next, the station controller 51 activates the secondary electric blower 49. The activated secondary electric blower 49 sucks in air from the secondary dust container 48 to generate the negative pressure. That is, the secondary electric blower 49 applies the negative pressure to the secondary dust container 48 after the drive source 149 opens the waste-outlet lid 92. The secondary electric blower 49 applies the negative pressure to the secondary dust container 48 after the drive source 149 opens the suction-port lid 94. The secondary electric blower 49 applies the negative pressure to the secondary dust container 48 after the drive source 149 drives the dust-removal mechanism 95.

The negative pressure acting in the secondary dust container 48 acts in the primary dust container 13 through the dust transfer tube 43 and the waste outlet 91. As a result, the primary dust container 13 sucks in air from the suction port 93. At this time, the air is also sucked from the connection port 18. The air having been sucked into the primary dust container 13 causes the coarse dust in the coarse-dust collecting chamber 71 to flow out from the coarse-dust waste-outlet 101 to the dust transfer tube 43 and also causes the fine dust in the filter chamber 72 to flow out from the fine-dust waste-outlet 102 to the dust transfer tube 43. The dust (i.e., dust mixed with the coarse dust and the fine dust) having flowed into the dust transfer tube 43 is sucked into the secondary dust container 48 through the dust transfer tube 43.

The first centrifugal separator 144 of the secondary dust container 48 separates and accumulates the coarse dust from the dust that has flowed in from the dust transfer tube 43. The second centrifugal separator 145 separates and accumulates the fine dust that has passed through the first centrifugal separator 144.

In the electric vacuum cleaner device 1 according to the present embodiment, not the cleaner body 7 but the station 2 includes the drive source 149 that generates the opening drive force and the closing drive force of the waste-outlet lid 92 of the vacuum cleaner 3. Consequently, the electric vacuum cleaner device 1 can connect the primary dust container 13 of the vacuum cleaner 3 to the secondary dust container 48 of the station 2, and can transfer the dust accumulated in the primary dust container 13 to the secondary dust container 48 without increasing the weight of the cleaner body 7 and without requiring a user's operation.

In the electric vacuum cleaner device 1 according to the present embodiment, not the cleaner body 7 but the station 2 includes the drive source 149 that generates the opening drive force and the closing drive force of the suction-port lid 94 of the vacuum cleaner 3. Consequently, the electric vacuum cleaner device 1 can connect the primary dust container 13 of the vacuum cleaner 3 to the secondary dust container 48 of the station 2, and can transfer the dust accumulated in the primary dust container 13 to the secondary dust container 48 without increasing the weight of the cleaner body 7 and without requiring a user's operation.

Additionally, the electric vacuum cleaner device 1 according to the present embodiment includes the coupler 156 for connecting the power transmission passage 155.

Consequently, the electric vacuum cleaner device 1 can reliably transmit the driving force generated by the drive source 149 to the waste-outlet lid 92 and the suction-port lid 94.

Further, the electric vacuum cleaner device 1 according to the present embodiment includes the coupler 156 equipped with the coupling 120. Consequently, the electric vacuum cleaner device 1 can easily transmit the rotational force as the driving force generated by the drive source 149 such as a motor.

Moreover, the electric vacuum cleaner device 1 according to the present embodiment establishes the engagement of the coupling 120 by the driving force of the drive source 149. Consequently, the electric vacuum cleaner device 1 can establish the engagement of the coupler 156 simply by returning the cleaner body 7 to the station 2 without requiring a user's operation. That is, the electric vacuum cleaner device 1 never gives a user burden of establishing the engagement of the coupler 156.

Furthermore, the electric vacuum cleaner device 1 according to the present embodiment includes the disengaging spring 157 that generates the force for disengagement of the coupling 120, and the cam mechanism 158 that establishes the engagement of the coupling 120 by the driving force generated by the drive source 149. Consequently, when the drive source 149 is stopped, the electric vacuum cleaner device 1 can disengage the driven part 115 and the driving part 116 of the coupling 120 and can easily separate the cleaner body 7 from the station 2 and easily connect the cleaner body 7 to the station 2 in the storage configuration of the electric vacuum cleaner device 1.

In addition, the electric vacuum cleaner device 1 according to the present embodiment includes the secondary electric blower 49 that applies the negative pressure to the secondary dust container 48 after the drive source 149 opens the waste-outlet lid 92. Consequently, while the electric vacuum cleaner device 1 is opening the waste-outlet lid 92, i.e., in a period during which the connection between the primary dust container 13 of the vacuum cleaner 3 and the secondary dust container 48 of the station 2 is not satisfactorily established, there is no risk of scattering the dust in an attempt to move the dust.

Further, the electric vacuum cleaner device 1 according to the present embodiment uses the drive source 149 as the driving force of the dust-removal mechanism 95. Consequently, the electric vacuum cleaner device 1 does not require the user to operate the dust-removal mechanism 95 and does not give an inconvenience to the user.

Moreover, the electric vacuum cleaner device 1 according to the present embodiment includes the drive source 149 that executes the opening drive and closing drive of the waste-outlet lid 92, the opening drive and closing drive of suction-port lid 94, the establishing the engagement of the coupler 156, and the drive of the dust-removal mechanism all together. Consequently, the electric vacuum cleaner device 1 contributes to downsizing and weight reduction of the cleaner body 7.

Thus, according to the electric vacuum cleaner device 1 of the present embodiment, it is possible to form the air path connecting the primary dust container 13 and the secondary dust container 48, i.e., to generate the driving force for opening and closing the waste outlet 91 without impairing the convenience of the vacuum cleaner 3.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST 1 electric vacuum cleaner device
2 station

3 vacuum cleaner
7 cleaner body
8 hose
11 body housing
12 wheel
12*a*, 12*b* auxiliary wheel
13 primary dust container
15 primary electric blower
16 cleaner controller
17 rechargeable battery
17*a* unit cell
18 connection port
19 charging electrode
21 connecting tube
22 dust collecting hose
23 hand operation tube
25 grip
26 input unit
27 extension tube
28 cleaning head
26*a* stop switch
26*b* start switch
26*c* brush switch
31 suction port
32 rotatable brush
33 electric motor
41 platform
42 dust collection unit
43 dust transfer tube
45 charging terminal
46 bulge
47 housing
48 secondary dust container
49 secondary electric blower
51 station controller
52 power cord
61 dust container chamber
61 dust-container insertion/extraction port
62 electric blower chamber
64 separation unit
65 dust collection unit
66 communication passage
68 first separator
69 filter
71 coarse-dust collecting chamber
72 filter chamber
73 dust collecting chamber
75 nozzle
76 first filter frame
77 first mesh filter
78 container body
78*a* suction port
79 coarse-dust discharge port
81 relay air-passage
82 coarse-dust collecting chamber outlet
83 partition wall
84 second mesh filter
86 filter
87 filter
88 secondary filter frame
86*a* ridge line
89 secondary filter outlet
91 waste outlet
92 waste-outlet lid
93 suction port
94 suction-port lid
95 dust-removal mechanism
96 power transmission mechanism
97 machine chamber
98 body-housing waste-outlet
99 shaft
101 coarse-dust waste-outlet
102 fine-dust waste-outlet
103 packing
105 rack
105*a* hole
105*b* tooth
106 driven unit
107 gear
107*a* tooth
108 frame
109 slider
111 dust remover
112 rail
115 driven part
116 driving part
117 first transmission mechanism
118 second transmission mechanism
119 third transmission mechanism
120 coupling
121 first gear
122 second gear
123 lever
123*a* tooth
124 guide unit
125 stopper
126 groove
127 guide plate
128 slider
129 waste-lid closing spring
131 return spring
142 dust collection unit
143 centrifugal separation unit
144 first centrifugal separator
145 second centrifugal separator
146 downstream air duct
148 connection guide
149 drive source
151 power transmission mechanism
151*a*, 151*b*, 151*c* gear
155 power transmission passage
156 coupler
157 disengaging spring
158 cam mechanism
161 arc-shaped groove
162 shaft
163 driving member
164 driven member
164*a* first cam surface
164*b* second cam surface
164*c* third cam surface

The invention claimed is:

1. An electric vacuum cleaner device, comprising:

a station; and a vacuum cleaner configured to be connectable to and detachable from the station, wherein the vacuum cleaner is equipped with a primary dust container that includes: a container body delineating a dust collecting chamber that accumulates dust sucked into the vacuum cleaner and equipped with a waste outlet that discharges the dust accumulated in the dust collecting chamber; and a waste-outlet lid configured to open and close the waste outlet, the station includes: a secondary dust container configured to accumulate the dust discharged from the primary dust container; and a drive source configured to generate an opening drive force and a closing drive force of the waste-outlet lid, the electric vacuum cleaner device further includes a coupler configured to engage and disengage a power transmission path between the station and the vacuum cleaner, the power transmission path being for transmitting a driving force from the drive source to the waste-outlet lid, the power transmission path includes a first power transmission mechanism on the vacuum cleaner, and a second power transmission mechanism on the station, and the coupler includes a driven part provided in the first power transmission mechanism, and a driving part provided in the second power transmission mechanism so as to be coupled to the driven part.

2. The electric vacuum cleaner device according to claim 1, wherein the vacuum cleaner includes: a suction port configured to introduce air directly from outside of an air passage including the primary dust container; and a suction-port lid configured to open and close the suction port; and wherein the drive source is configured to generate an opening drive force and a closing drive force of the suction-port lid.

3. The electric vacuum cleaner device according to claim 2, further comprising an electric blower configured to apply negative pressure to the secondary dust container after the drive source opens the waste-outlet lid.

4. The electric vacuum cleaner device according to claim 2, further comprising:

a filter configured to filter and separate dust from air sucked into the primary dust container; and a dust-removal mechanism configured to remove the dust adhered to the filter, wherein the drive source is configured to generate a driving force of the dust-removal mechanism.

5. The electric vacuum cleaner device according to claim 1, wherein the coupler includes a coupling.

6. The electric vacuum cleaner device according to claim 5, wherein the coupler is configured to engage the driving part and the driven part of the coupling by the driving force of the drive source.

7. The electric vacuum cleaner device according to any one of claim 6, further comprising an electric blower configured to apply negative pressure to the secondary dust container after the drive source opens the waste-outlet lid.

8. The electric vacuum cleaner device according to claim 5, wherein the coupler further includes: a spring configured to generate a force for disengaging the driving part and the driven part of the coupling; and a cam mechanism configured to convert the driving force generated by the drive source into a force for engaging the driving part and the driven part of the coupling.

9. The electric vacuum cleaner device according to claim 8, further comprising an electric blower configured to apply negative pressure to the secondary dust container after the drive source opens the waste-outlet lid.

10. The electric vacuum cleaner device according to claim 5, further comprising an electric blower configured to apply negative pressure to the secondary dust container after the drive source opens the waste-outlet lid.

11. The electric vacuum cleaner device according to claim 5, further comprising:

a filter configured to filter and separate dust from air sucked into the primary dust container; and a dust-removal mechanism configured to remove the dust adhered to the filter, wherein the drive source is configured to generate a driving force of the dust-removal mechanism.

12. The electric vacuum cleaner device according to claim 1, further comprising an electric blower configured to apply negative pressure to the secondary dust container after the drive source opens the waste-outlet lid.

13. The electric vacuum cleaner device according to claim 1, further comprising:

a filter configured to filter and separate dust from air sucked into the primary dust container; and a dust-removal mechanism configured to remove the dust adhered to the filter, wherein the drive source is configured to generate a driving force of the dust-removal mechanism.

* * * * *